US009245517B2

(12) United States Patent
Asada et al.

(10) Patent No.: US 9,245,517 B2
(45) Date of Patent: Jan. 26, 2016

(54) NOISE REDUCTION AUDIO REPRODUCING DEVICE AND NOISE REDUCTION AUDIO REPRODUCING METHOD

(75) Inventors: Kohei Asada, Kanagawa (JP); Shiro Suzuki, Kanagawa (JP); Tetsunori Itabashi, Kanagawa (JP); Kazunobu Ohkuri, Kanagawa (JP)

(73) Assignee: Sony Corporation, Tokyo (JP)

( * ) Notice: Subject to any disclaimer, the term of this patent is extended or adjusted under 35 U.S.C. 154(b) by 1173 days.

(21) Appl. No.: 12/486,054

(22) Filed: Jun. 17, 2009

(65) Prior Publication Data

US 2009/0323976 A1 Dec. 31, 2009

(30) Foreign Application Priority Data

Jun. 27, 2008 (JP) ..... 2008-168373

(51) Int. Cl.
*G10K 11/178* (2006.01)
*G10L 21/06* (2013.01)

(52) U.S. Cl.
CPC ..... *G10K 11/178* (2013.01); *G10K 2210/1081* (2013.01); *G10L 2021/065* (2013.01)

(58) Field of Classification Search
USPC ..... 381/71.1, 71.2, 71.5, 71.6, 71.7, 71.8, 381/71.11, 71.14
See application file for complete search history.

(56) References Cited

U.S. PATENT DOCUMENTS 5,212,764 A * 5/1993 Ariyoshi ..... G10L 21/0208 381/94.7
5,251,263 A 10/1993 Andrea et al.
5,937,070 A 8/1999 Todter et al.
2008/0112570 A1* 5/2008 Asada ..... G10K 11/1782 381/71.6

FOREIGN PATENT DOCUMENTS

| | | | |
|---|---|---|---|
| GB | 2330048 | A | 10/1997 |
| JP | 02-039799 | A | 2/1990 |
| JP | 03-096199 | A | 4/1991 |
| JP | 03-214892 | A | 9/1991 |
| JP | 06-503897 | T | 4/1994 |

(Continued)

OTHER PUBLICATIONS

MATLAB Multimedia Signal Processing Music, Image, Transmission; Chpt 5, pp. 67-75 (w/Fig. 5.1).

(Continued)

*Primary Examiner* — Duc Nguyen
*Assistant Examiner* — George Monikang
(74) *Attorney, Agent, or Firm* — Wolf, Greenfield & Sacks, P.C.

(57) ABSTRACT

A noise reduction audio reproducing method includes the steps of: generating, from an audio signal of collected and obtained noise, an audio signal for noise cancellation to cancel the noise by synthesizing the audio signal for noise cancellation and the noise in an acoustic manner, reproducing the audio signal for noise cancellation acoustically to synthesize this with the noise in an acoustic manner; emphasizing an audio component to be listened to, of collected audio; synthesizing an audio signal with the audio component to be listened to being emphasized, and the audio signal for noise cancellation to supply the synthesized signal thereof to an electro-acoustic converting unit; and controlling so as to supply an audio signal, with the audio component to be listened to having been emphasized, to a synthesizing unit, regarding only a section based on a control signal.

13 Claims, 24 Drawing Sheets

(56) References Cited

FOREIGN PATENT DOCUMENTS

| | | | |
|---|---|---|---|
| JP | 07-264699 | A | 10/1995 |
| JP | 8-160994 | A | 6/1996 |
| JP | 2001-228892 | | 8/2001 |
| JP | 2004-325284 | A | 11/2004 |
| JP | 2005-189836 | A | 7/2005 |
| JP | 2007-002393 | A | 1/2007 |
| JP | 2007-108522 | A | 4/2007 |
| JP | 2007-110536 | A | 4/2007 |
| JP | 2007-193035 | | 8/2007 |
| JP | 2007-212611 | A | 8/2007 |
| JP | 2007-243739 | A | 9/2007 |
| JP | 2007-259241 | A | 10/2007 |
| JP | 2007-336460 | A | 12/2007 |
| JP | 2008-028937 | A | 2/2008 |
| JP | 2008-042508 | A | 2/2008 |
| JP | 2008-092365 | A | 4/2008 |
| JP | 2008-122729 | | 5/2008 |
| JP | 2008-124792 | A | 5/2008 |
| JP | 2008-197438 | A | 8/2008 |
| WO | WO 2008/070005 | A2 | 6/2008 |

OTHER PUBLICATIONS

Tozawa et al., "Musical Noise Reduction Using Morphology Process in Spectral Subtraction", The 18th Workshop on Circuits and Systems in Karuizawa; Apr. 25-26, 2005, pp. 159-164.

* cited by examiner

FIG. 4

$$P = \frac{1}{1 + ADHM\beta} N + \frac{AHD}{1 + ADHM\beta} ES \quad \cdots \text{(EXPRESSION 1)}$$

$$\left| \frac{1}{1 + ADHM\beta} \right| < 1 \quad \cdots \text{(EXPRESSION 2)}$$

$$E = (1 + ADHM\beta) \quad \cdots \text{(EXPRESSION 3)}$$

$$P = \frac{1}{1 + ADHM\beta} N + ADHS \quad \cdots \text{(EXPRESSION 4)}$$

$$P = -F'ADHM\alpha N + FN + ADHS \quad \cdots \text{(EXPRESSION 5)}$$

$$P = -F'ADHM\alpha \quad \cdots \text{(EXPRESSION 6)}$$

$$P = ADHS \quad \cdots \text{(EXPRESSION 7)}$$

RECORDING SYSTEM

REPRODUCING SYSTEM

NOISE REDUCTION AUDIO REPRODUCING DEVICE AND NOISE REDUCTION AUDIO REPRODUCING METHOD

CROSS REFERENCES TO RELATED APPLICATIONS

The present application claims the benefit under 35 U.S.C. §119 of Japanese Patent Application No. 2008-168373, filed in the Japan Patent Office on Jun. 27, 2008, the entire content of which is hereby incorporated by reference.

BACKGROUND OF THE INVENTION

1. Field of the Invention

The present invention relates to a noise reduction audio reproducing device and method whereby audio to be listened to can be reproduced comfortably even under a noise environment.

2. Description of the Related Art

Hitherto, a noise reduction technique has been proposed as a technique for realizing improvement in audio clarity by suppressing noise to perform audio emphasis. With the present Specification, noise reduction will be abbreviated as NR below.

For example, with a headphone system whereby users can perform conversation while putting on headphones, and with an earphone system having a hearing aid or hearing aid function (external monitor function), a system configuration can be conceived such as shown in FIG. 25A.

That is to say, though not illustrated in the drawing, for example, microphones 1L and 1R are attached to the outside of headphone casings (for the left ear and for the right ear) such as earmuffs with strong sound insulation and difficulty in attachment/detachment as an example of acousto-electric converter. Subsequently, after audio signals collected at the microphones 1L and 1R are amplified at a microphone amplifier 2, the audio signals are converted into digital audio signals at an A/D converter 3, and are supplied to an NR processing unit 4.

The NR processing unit 4 subjects the digital audio signals to NR processing to suppress noise, thereby performing audio emphasis. The digital audio signals subjected to audio emphasis are returned to analog audio signals at a D/A converter 5, and are supplied to a speaker or headphone driver unit through a power amplifier 6, and are reproduced acoustically.

The spectrum subtracting method (hereafter, abbreviated as "SS method") described in "MATLAB multimedia signal processing, lower volume, audio, image, and communication" collective writing of Masaaki IKEHARA, Tetsuya SHIMATANI, and Yukitoshi SANADA, BAIFUKAN Co., Ltd issue, pp 67-74, for example, can be employed as the NR processing at the NR processing unit 4, and the system configuration in FIG. 25A can be rewritten such as shown in FIG. 25B. That is to say, the NR processing unit 4 is replaced with an SS-method processing unit 4A and musical noise removal filter 4B.

The SS method is a method for subtracting the power spectrum of the noise estimated separately from the power spectrum of an audio signal to which noise is added, subjecting the power spectrum thereof to inverse Fourier transform, thereby restoring an audio signal from which the noise is removed.

The power spectrum of the noise to be subtracted is estimated and stored in a storage unit beforehand. For example, with a soundless section of audio to be listened to, audio collected at the microphones 1L and 1R can be stored in the storage unit as estimated noise. If the power spectrum of the estimated noise is suitable, noise reduction effects are great. Subsequently, if the noise estimated as the power spectrum of the noise to be subtracted is steady noise, the noise is reduced by the SS method, and only the audio component to be listened to is emphasized. Though this SS method is a very simple algorithm, very high noise removal effects can be obtained.

Note that, in the case of employing the SS method, noise due to lack of phase information called as musical noise occurs, so it is desirable to employ a configuration wherein the musical noise removal filter 4B is provided on the subsequent stage of the SS-method processing unit 4A. Removal of this musical noise has been described in "Musical Noise Reduction Using Morphology Process in Spectral Subtraction" Hideaki TOZAWA, Yukihiro NOMURA, Noritaka YAMASHITA, Jianming LU, Hiroo SEKIYA, Takashi YAHAGI Graduate School of Science and Technology, Chiba University, The 18th Workshop on Circuits and Systems in Karuizawa, Apr. 25-26, 2005.

SUMMARY OF THE INVENTION

Incidentally, the NR processing is not a technique for canceling noise with the actual audio reproduction environment of an audio signal, but a technique for obtaining noise reduction effects on a computer by signal processing regarding audio signals. Originally, the audio subjected to the NR processing has to be listened to comfortably as to a user. However, in a case where the actual audio reproduction environment is under noise, the audio signal subjected to the NR processing itself is obscured in noise, the content of audio becomes obscure, and becomes inaudible in some cases.

It has been found desirable to allow a user to listen to audio clearly, even if the actual audio reproduction environment is a noise environment.

A noise reduction audio reproducing device according to an embodiment of the present invention includes: a noise cancellation processing unit to generate, from an audio signal of noise collected and obtained by a first acousto-electric converting unit to collect noise, an audio signal for noise cancellation to cancel the noise by synthesizing the audio signal for noise cancellation and the noise in an acoustic manner, and cause an electro-acoustic converting unit to reproduce the audio signal for noise cancellation acoustically to synthesize this and the noise in an acoustic manner; a second acousto-electric converting unit to collect an audio signal to be listened to; an audio emphasizing unit to emphasize an audio component to be listened to, of audio signals collected by the second acousto-electric converting unit; a synthesizing unit to synthesize an audio signal with the audio component to be listened to being emphasized from the audio emphasizing unit, and the audio signal for noise cancellation to supply the synthesized signal thereof to the electro-acoustic converting unit; and a control unit to perform control so as to supply an audio signal with the audio component to be listened to, having been emphasized from by audio emphasizing unit, to the synthesizing unit regarding only a section based on a control signal.

According to the above configuration, noise in the actual audio reproduction environment is canceled or reduced by the noise cancellation processing unit. However, the audio signal to be listened to is also reduced simultaneously at that time. On the other hand, after the audio component to be listened to is emphasized by the audio emphasizing unit, the audio component to be listened to is synthesized with the audio signal for noise cancellation, and is supplied to the electro-acoustic converting unit. Accordingly, the audio signal to be listened to of which the noise has been reduced by the noise cancellation processing unit is synthesized with the audio signal to be listened to of which the audio component has been emphasized by the audio emphasizing unit, and accordingly, the listener can listen to the synthesized audio. Accordingly, the audio signal to be listened to has been converted into audio with improvement in clarity which the listener can listen to comfortably.

A noise reduction audio reproducing device according to an embodiment of the present invention includes: an audio signal for noise cancellation generating unit to generate, from an audio signal of noise collected and obtained by an acousto-electric converting unit to collect noise, an audio signal for noise cancellation to cancel the noise by synthesizing the audio signal for noise cancellation and the noise in an acoustic manner; an electro-acoustic converting unit to reproduce the audio signal for noise cancellation acoustically to synthesize this and the noise in an acoustic manner; an audio emphasizing unit to emphasize an audio component to be listened to, of audio signals from the audio signal for noise cancellation generating unit; a synthesizing unit to synthesize an audio signal with the audio component to be listened to being emphasized from the audio emphasizing unit, and the audio signal for noise cancellation to supply the synthesized signal thereof to the electro-acoustic converting unit; and a control unit to perform control so as to supply an audio signal with the audio component to be listened to having been emphasized by the audio emphasizing unit to the synthesizing unit, regarding only a section based on a control signal.

According to the above configuration, noise in the actual audio reproduction environment is canceled or reduced by the noise cancellation processing unit. The audio signal to be listened to is also reduced simultaneously at that time. However, after the audio component to be listened to of the audio signal for noise cancellation is emphasized by the audio emphasizing unit, the audio component to be listened to is synthesized with the audio signal for noise cancellation, and is supplied to the electro-acoustic converting unit. Accordingly, the audio signal to be listened to of which the noise has been reduced by the noise cancellation processing unit is synthesized with the audio signal to be listened to of which the audio component has been emphasized by the audio emphasizing unit, and accordingly, the listener can listen to the synthesized audio. Accordingly, the audio signal to be listened to has been converted into audio with improvement in clarity which the listener can listen to comfortably.

According to the above configurations, the audio signal to be listened to, of which the noise has been reduced by the noise cancellation processing unit, is synthesized with the audio signal to be listened to of which the audio component has been emphasized by the audio emphasizing unit, and accordingly, the listener can listen to the synthesized audio. Accordingly, the audio signal to be listened to has been converted into audio with improvement in clarity which the listener can listen to comfortably.

BRIEF DESCRIPTION OF THE DRAWINGS

FIG. 4 is a diagram showing expressions employed for describing an example of a noise canceling system employed for an embodiment of the present invention;

DESCRIPTION OF THE PREFERRED EMBODIMENTS

Embodiments of the noise reduction audio reproducing device and method according to the present invention will be described below with reference to the drawings.

With the present invention, in addition to the above-mentioned NR function, reduction in noise is realized in the actual audio reproduction environment by the noise canceling method, thereby improving the clarity of audio to be listened to, which is collected at an acousto-electric converting unit (microphones) overall.

Now, description will be made regarding the noise canceling (hereafter, abbreviated as NC) technique. The NC technique is a technique wherein an audio signal for noise cancellation is generated from noise collected and obtained at microphones within audio listening space, this audio signal for noise cancellation is synthesized with noise acoustically, thereby canceling the noise. This is a technique for leaving wanted sound among noise space, and eliminating unwanted sound.

The NC function is similar to but not the same as the NR function, the NR obtains noise reduction effects on a computer by signal processing, but the NC performs noise canceling by generating a signal having generally the opposite waveform of an input audio signal within physical space. With the following description, let us say that the NR and NC are distinguished such as described above.

Description of NC System

Before describing an embodiment of the noise reduction audio reproducing device according to the present invention, the NC system will be described. With the NC system, there are a feedback method and feed-forward method. Note that references regarding the NC system include Japanese Unexamined Patent Application Publication No. 2008-122729.

Feedback NC System

Figure 2:
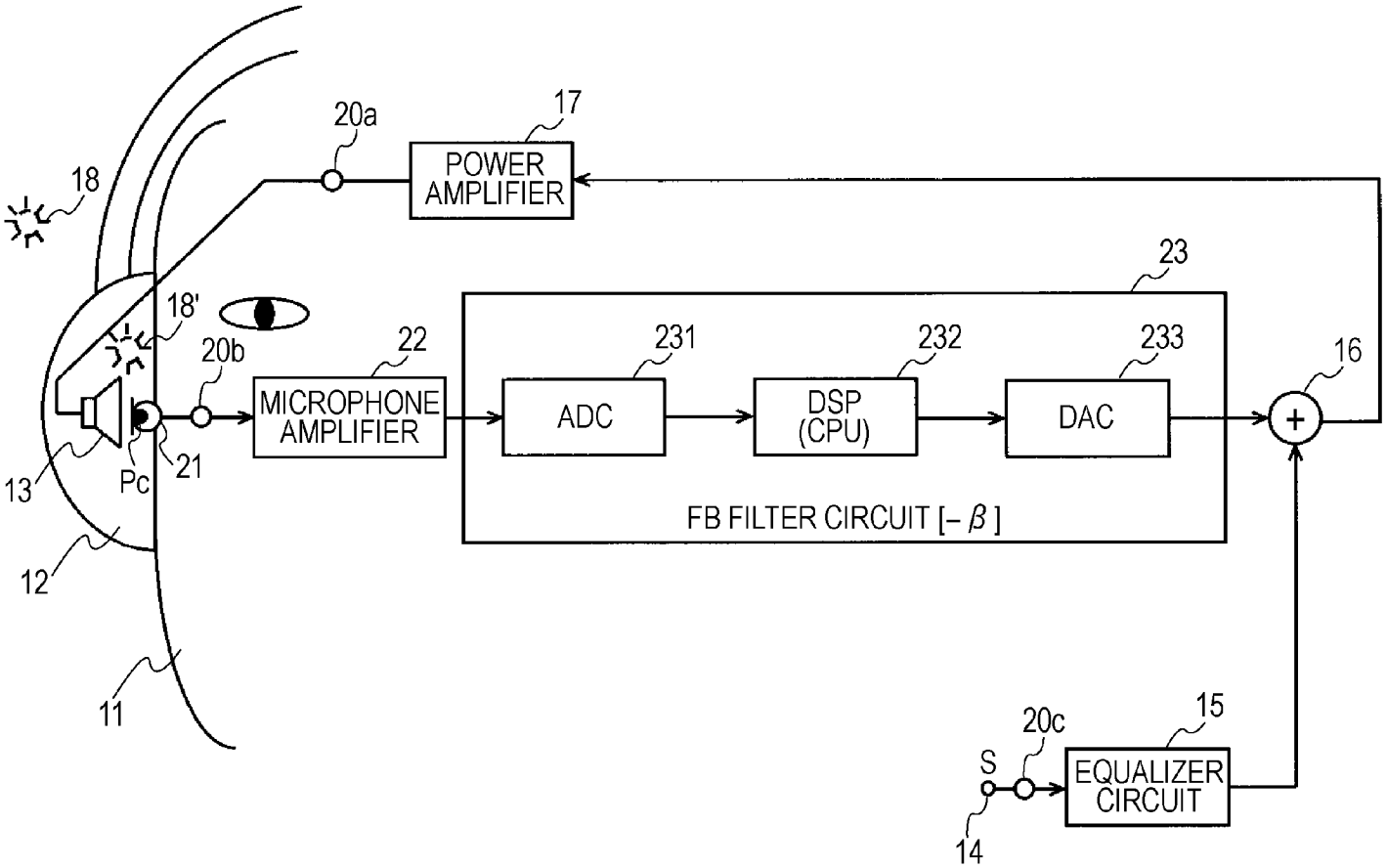
FIG. 2 is a diagram for describing an example of a noise canceling system to be employed for an embodiment of the present invention.

First, the feedback NC system will be described. FIG. 2 is a block diagram illustrating a configuration example of a headphone device mounting on the NC function of the feedback method.

Figure 1:
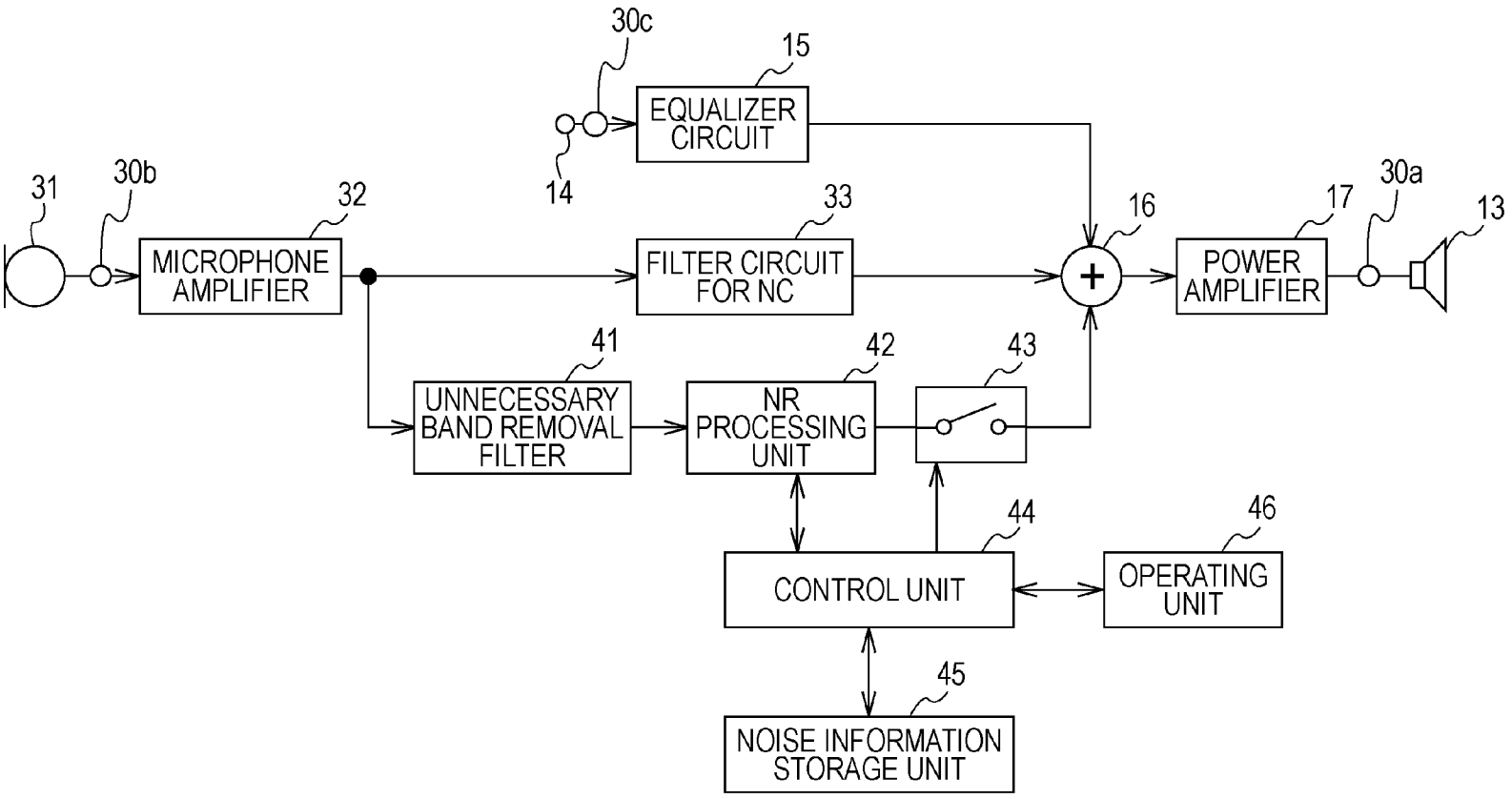
FIG. 1 is a block diagram illustrating a hardware configuration example of a first embodiment of a noise reduction audio reproducing device according to the present invention.

In order to facilitate explanation, FIG. 1 illustrates the configuration regarding only the right ear side portion of a listener 11 of a headphone device. This is true for the case of describing the NC system of later-described feed-forward method. Note that it goes without saying that the left side portion is also configured in the same way.

FIG. 2 illustrates a state in which the right ear of the listener 11 is covered with a headphone casing (housing portion) 12 for the right ear by the listener 11 putting on a headphone device according to an embodiment. A headphone driver unit (hereafter, referred to as a headphone driver) 13 serving as an electro-acoustic converting unit for acoustically reproducing an audio signal which is an electric signal is provided in the inner side of the headphone casing 12.

Subsequently, for example, a music signal passed through an audio signal input terminal 14 is supplied to a power amplifier 17 through an equalizer circuit 15 and adding circuit 16, the audio signal passed through the power amplifier 17 is supplied to the headphone driver 13, and is reproduced acoustically. Thus, the reproduced sound of the music signal is emitted to the right ear of the listener 11.

The audio signal input terminal 14 is configured of a headphone plug to be inserted into a headphone jack of a portable music reproducing device. With this NC system, there are provided the equalizer circuit 15, adding circuit 16, power amplifier 17, and an NC function unit 20 within an audio signal transmission line between the audio signal input terminal 14, and the headphone driver 13 for the left/right ear. This NC function unit 20 includes a microphone 21 serving as an acousto-electric converting unit, microphone amplifier 22, and filter circuit 23 for noise reduction, and so forth.

Though not shown in the drawing, this NC function unit 20 is connected to the headphone driver 13, microphone 21, and headphone plug making up the audio signal input terminal 14 by a connection cable. Reference symbols 20*a*, 20*b*, and 20*c* denote connection terminal portions where a connection cable is connected to the headphone device.

With the NC system of the example in FIG. 2, noise intruding into the music listening position of the listener 11 within the headphone casing 12 from a noise source 18 outside the headphone casing 12 is reduced by the feedback method in the music listening environment of the listener 11. Thus, the listener 11 is allowed to listen to music in a comfortable environment.

With the feedback NC system, noise at an acoustic synthesis position (noise cancel point Pc) where noise and the acoustic reproduced audio of an audio signal for noise cancellation are synthesized, of the music listening position of the listener 11 is collected at the microphone 21.

Accordingly, with the feedback NC system, the microphone 21 for noise collection is provided at the noise cancel point Pc which is the inner side of the headphone casing (housing portion) 12. The sound at the position of the microphone 21 becomes a control point, so noise attenuation effects are taken into consideration, and the noise cancel point Pc is usually regarded as a position close to the ear, i.e., the front face of the diaphragm of the headphone driver 13, and the microphone 21 is provided at this position.

With the NC system, the reverse phase component of the noise collected at the microphone 21 thereof is generated at an audio signal for noise cancellation generating unit (hereafter, referred to as "audio signal for NC generating unit") as an audio signal for noise cancellation (hereafter, audio signal for NC). Subsequently, the generated audio signal for NC thereof is supplied to the headphone driver 13 to be reproduced acoustically, thereby reducing the noise externally intruding into the headphone casing 12.

Here, the noise at the noise source 18, and noise 18' intruding into the headphone casing 12 do not have the same property. However, with the feedback NC system, the noise 18' intruding into the headphone casing 12, i.e., the noise 18' which is a reduction target is collected at the microphone 21.

Accordingly, with the feedback method, the audio signal for NC generating unit should generate the above-mentioned reverse phase component of the noise 18' so as to cancel the noise 18' collected at the noise cancel point Pc by the microphone 21.

With the example in FIG. 2, a digital filter circuit 23 is employed as the audio signal for NC generating unit of the feedback method. With the present embodiment, an audio signal for NC is generated by the feedback method, so the digital filter circuit 23 will be referred to as an FB filter circuit 23 below.

The FB filter circuit 23 is configured of a DSP (Digital Signal Processor) 232, an A/D conversion circuit 231 provided on the previous stage thereof, and a D/A conversion circuit 233 provided on the subsequent stage thereof.

The analog audio signal collected and obtained at the microphone 21 is supplied to the FB filter circuit 23 through the microphone amplifier 22, and is converted into a digital audio signal by the A/D conversion circuit 231. Subsequently, the digital audio signal thereof is supplied to the DSP 232.

With the DSP 232, a digital filter for generating a digital audio signal for NC of the feedback method is configured.

This digital filter generates from a digital audio signal input thereto the above-mentioned digital audio signal for NC having the property corresponding to the filter coefficient serving as a parameter set thereto. A predetermined filter coefficient is set as the filter coefficient set to the digital filter of the DSP 232 beforehand.

However, an arrangement may be made, for example, wherein the filter coefficients corresponding to the actual multiple types of reproduction acoustic environment are stored in memory beforehand, and the user selects the filter coefficient according to the reproduction acoustic environment at that time to set this in the digital filter.

Subsequently, the digital audio signal for NC generated at the DSP 232 is converted into an analog audio signal for NC at the D/A conversion circuit 233. Subsequently, this analog audio signal for NC is supplied to the adding circuit 16 as the output signal of the FB filer circuit 23.

An input audio signal (music signal or the like) S which the listener 11 desires to listen to through the headphones is supplied to the adding circuit 16 through the audio signal input terminal 14 and equalizer circuit 15. The equalizer circuit 15 subjects the input audio signal to acoustic correction.

The audio signal which is an addition result of the adding circuit 16 is supplied to the headphone driver 13 through the power amplifier 17, and is reproduced acoustically. The audio reproduced acoustically and emitted from the headphone driver 13 includes the acoustic reproduction component by the audio signal for NC generated at the FB filter 23. Of the audio reproduced acoustically and emitted at the headphone driver 13, the acoustic reproduction component by the audio signal for NC and the noise 18' are synthesized acoustically, thereby reducing (canceling) the noise 18' at the noise cancel point Pc.

Figure 3:
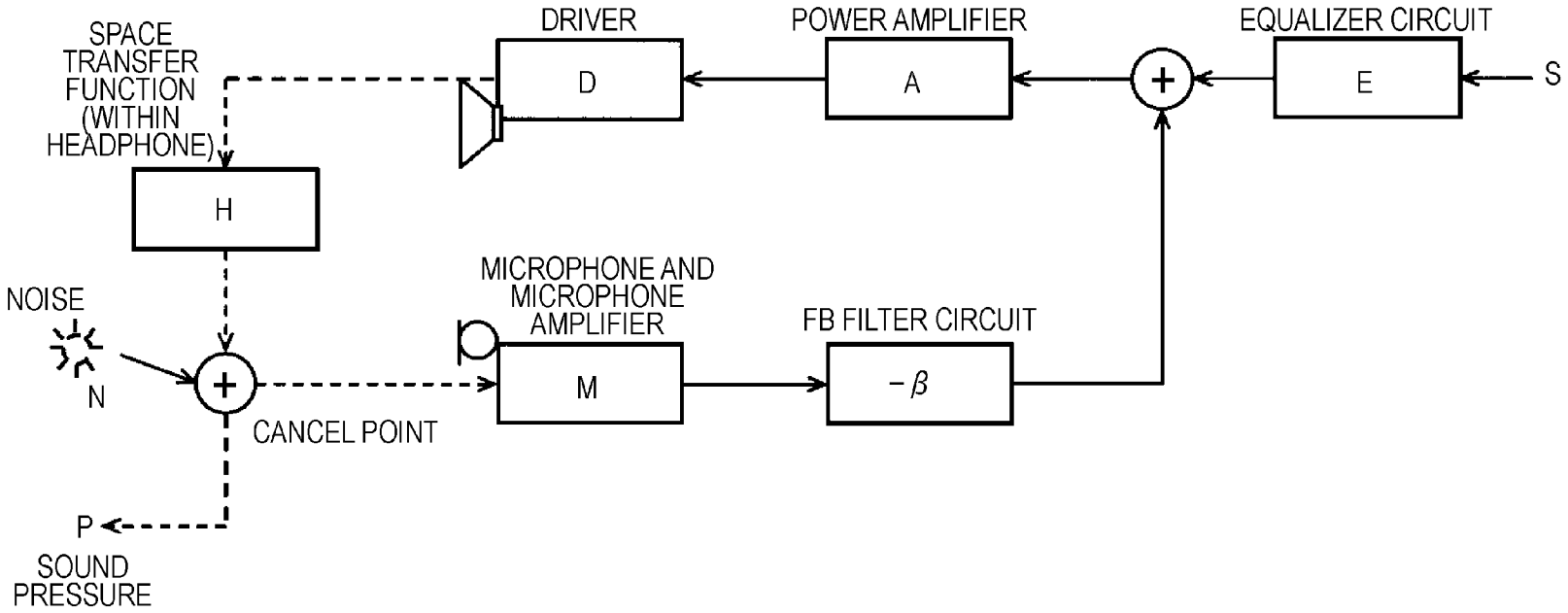
FIG. 3 is an equivalent circuit diagram for describing the noise canceling system in FIG. 2.

The noise canceling operation of the feedback NC system described above will be described employing transfer functions with reference to FIG. 3. Specifically, a block diagram, which corresponds to the block diagram shown in FIG. 2, representing each unit by employing the transfer function thereof is illustrated in FIG. 3. In FIG. 3, A denotes the transfer function of the power amplifier 17, D denotes the transfer function of the headphone driver 13, M denotes the transfer function corresponding to the portions of the microphone 21 and microphone amplifier 22, and $-\beta$ denotes the transfer function of a filter designed for feedback. Also, H denotes the transfer function of space from the headphone driver 13 to the microphone 21, and E denotes the transfer function of an equalizer to be applied to the audio signal S which is a listening target. Let us say that the above-mentioned transfer functions are indicated with complex representation.

Also, in FIG. 3, N denotes noise intruding into around the position of the microphone 21 within the headphone casing 12 from an external noise source, and P denotes sound pressure reaching the ear of the listener 11. Note that examples of a conceivable cause wherein external noise is propagated within the headphone casing 12 include a case where noise leaks from a gap of the ear pad portion as sound pressure, and a case where sound is propagated within the headphone casing 12 as a result of the headphone casing 12 receiving sound pressure and vibrating.

When representing such as shown in FIG. 3, the block in FIG. 3 can be represented with (Expression 1) in FIG. 4. In this (Expression 1), giving notice to noise N, it can be found that the noise N is attenuated to $1/(1+ADHM\beta)$. However, in order that the system of (Expression 1) operates as a noise canceling mechanism in a stable manner at a noise reduction target frequency band, (Expression 2) in FIG. 4 has to be held.

In general, the stability of the system relating to (Expression 2) in FIG. 4 can be interpreted as follows along with the fact that the absolute value of product of each transfer function with the feedback NC system is equal to or greater than 1 ($1 \ll |ADHM\beta|$), and the stability distinction of Nyquist with a classical control theory.

In FIG. 3, let us consider the "open loop" of the transfer function ($-ADHM\beta$) by cutting off a portion of a loop portion relating to the noise N (loop portion from the microphone 21 to the headphone driver 13). This has property represented with a Bode plot such as shown in FIG. 5.

Figure 5:
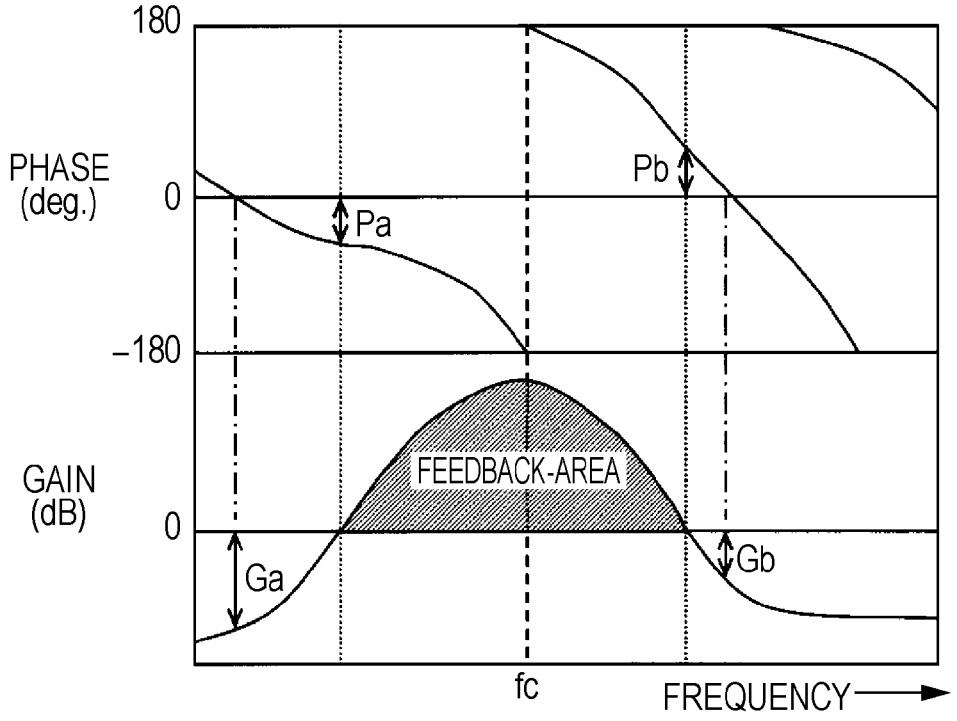
FIG. 5 is a diagram for describing the noise canceling system in FIG. 2.

In a case where this open loop is taken as a target, there is a the following two conditions in FIG. 5 have to be satisfied from the perspective of the stability distinction of Nyquist.

The gain has to be smaller than 0 dB when passing through the point of phase 0 degree The point of the phase 0 degree must not be included when the gain is equal to or greater than 0 dB In the case where the above-mentioned two conditions are not satisfied, positive feedback is applied to the loop, and consequently, oscillation (howling) is caused. In FIG. 5, Pa and Pb represent phase margins, and Ga and Gb represent gain margins, and when these margins are small, risk of oscillation is increased by individual difference or irregularities of wearing of the headphones.

Next, in addition to the above-mentioned noise reduction function, description will be made regarding a case where wanted sound is reproduced from the headphone driver of the headphones.

In FIG. 3, the audio signal S which is a listening target is a signal general term to be reproduced at the headphone driver of the headphones originally such as the sound of a microphone outside the casing (employed as a listening aid), an audio signal through communication (employed as a headset), and so forth, actually as well as audio signals.

Of the above-mentioned (Expression 1), sound pressure P is represented such as (Expression 4) in FIG. 4, with notice to the signal S such as (Expression 3) shown in FIG. 4, if an equalizer E is set.

Here, H denotes a transfer function from the headphone driver 13 to the microphone 21 (ear), and A and D denote the transfer functions of the properties of the power amplifier 17 and headphone driver 13, respectively. Accordingly, if we say that the position of the microphone 21 is very close to the ear position, it can be found that according to the headphone device of this example, the same property as headphones having no NC function can be obtained. Note that, at this time, the transfer property E of the equalizer circuit 15 is generally the same property as the open loop property as viewed from the frequency axis.

As described above, with the headphone device having the configuration in FIG. 2, the listener can listen to an audio signal to be listened to without any trouble while reducing noise. However, in this case, in order to obtain sufficient noise canceling effects, the filter coefficient corresponding to the property of noise transferred to the inner side of the headphone casing 12 from the external noise source 18 has to be set to the digital filter configured of the DSP 232.

Feed-Forward NC System

Figure 6:
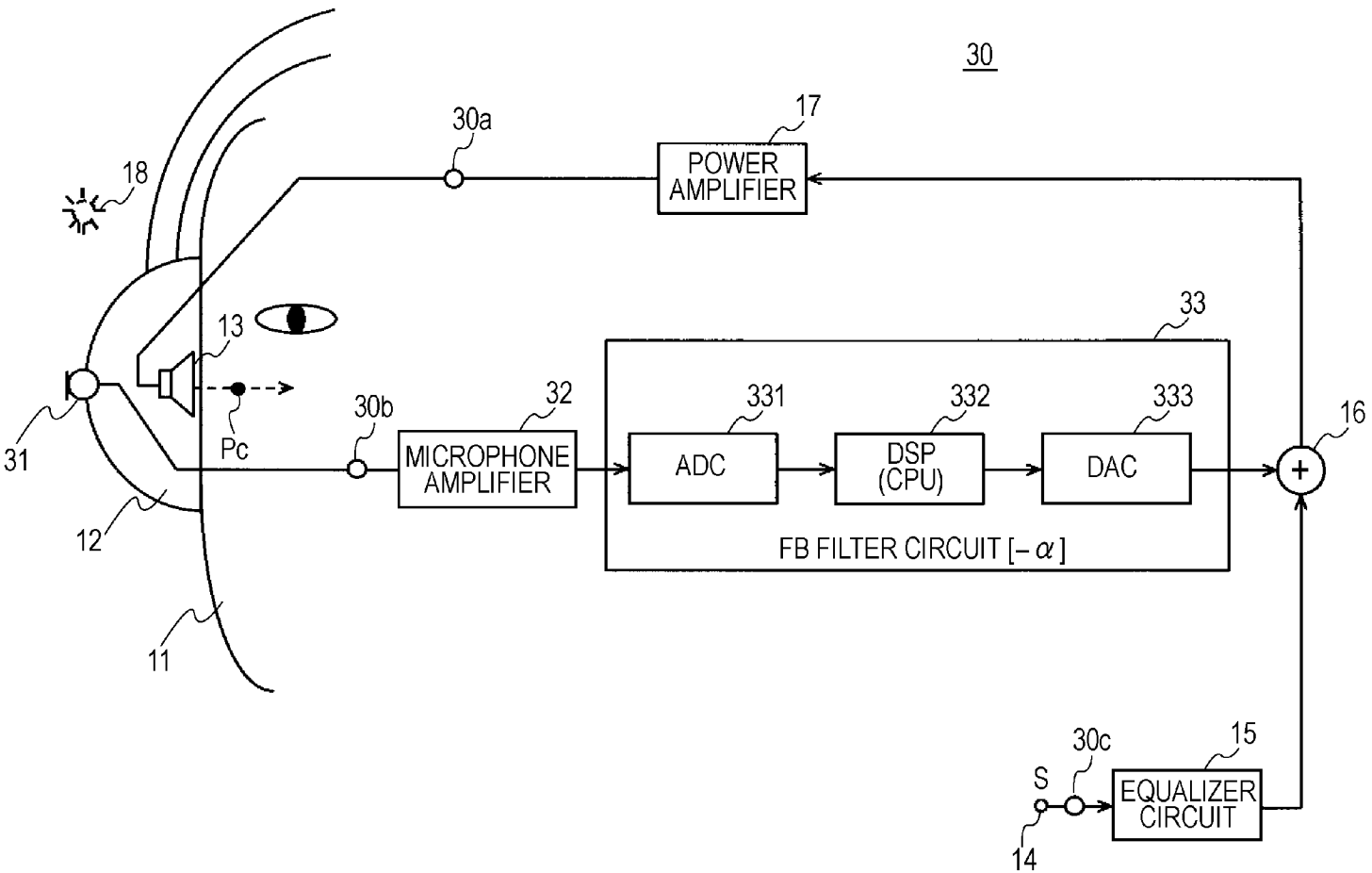
FIG. 6 is a diagram for describing another example of a noise canceling system employed for an embodiment of the present invention.

FIG. 6 is a block diagram for describing the feed-forward NC system. In FIG. 6, the same portions as those in the case of FIG. 2 are denoted with the same reference numerals. An NC function unit 30 in the example in FIG. 6 is configured so as to include a microphone 31 serving as an acousto-electric converting unit, microphone amplifier 32, and filter circuit 33 for noise reduction.

The NC function unit 30 is, in the same way as with the above-mentioned NC function unit 20 of the feedback method, connected to the headphone driver 13, microphone 31, and headphone plug making up the audio signal input terminal 14 by a connection cable. Reference symbols 30*a*, 30*b*, and 30*c* denote connection terminal portions where a connection cable is connected to the NC function unit 30.

With the example in FIG. 6, noise intruding into the music listening position of the listener 11 within the headphone casing 12 from the noise source 18 outside the headphone casing 12 is reduced by the feed-forward method in the music listening environment of the listener 11, thereby allowing the listener 11 to listen to music in a comfortable environment.

With the feed-forward NC system, basically, as shown in FIG. 6, the microphone 31 is installed in the outside of the headphone casing 12. With this NC system, the noise 18 collected at the microphone 31 is subjected to suitable filtering processing to generate an audio signal for noise cancellation. Subsequently, the generated audio signal for noise cancellation is reproduced acoustically at the headphone driver 13 within the headphone casing 12, and the noise (noise 18') is canceled at a portion close to the ear of the listener 11.

The noise 18 collected at the microphone 31, and the noise 18' within the headphone casing 12 have different properties corresponding to the difference of the spatial positions of both (including the difference between the outside and inside of the headphone casing 2). Accordingly, with the feed-forward method, an audio signal for NC is generated while expecting the difference of the spatial transfer functions between the noise from the noise source 18 collected at the microphone 31, and the noise 18' at the noise cancel point Pc.

With the present embodiment, a digital filter circuit 33 is employed as the audio signal for NC generating unit of the feed-forward method. With the present embodiment, an audio signal for NC is generated by the feed-forward method, so the digital filter circuit 33 will be referred to as an FF filter circuit 33 below.

The FF filter circuit 33 is configured of, completely in the same way as with the FB filter circuit 23, a DSP (Digital Signal Processor) 332, an A/D conversion circuit 331 provided on the previous stage thereof, and a D/A conversion circuit 333 provided on the subsequent stage thereof.

Subsequently, as shown in FIG. 6, the analog audio signal collected and obtained at the microphone 31 is supplied to the FF filter circuit 33 through the microphone amplifier 32, and is converted into a digital audio signal by the A/D conversion circuit 331. Subsequently, the digital audio signal thereof is supplied to the DSP 332.

With the DSP 332, a digital filter for generating a digital audio signal for NC of the feed-forward method is configured. This digital filter generates from a digital audio signal input thereto the above-mentioned digital audio signal for NC having the property corresponding to the filter coefficient serving as a parameter set thereto. The filter coefficient to be set to the digital filter of the DSP 332 is set in the same way as with the case of the above-mentioned DSP 232.

Subsequently, with the digital filter of the DSP 332, the digital audio signal for noise cancellation according to the filter coefficient thus set is generated.

Subsequently, the digital audio signal for noise cancellation generated at the DSP 332 is converted into an analog audio signal for NC at the D/A conversion circuit 333. Subsequently, this analog audio signal for NC is supplied to the adding circuit 16 as the output signal of the FF filer circuit 33.

An input audio signal (music signal or the like) S which the listener 11 desires to listen to through the headphones is supplied to the adding circuit 16 through the audio signal input terminal 14 and equalizer circuit 15. The equalizer circuit 15 subjects the input audio signal to acoustic correction.

The audio signal which is an addition result of the adding circuit 16 is supplied to the headphone driver 13 through the power amplifier 17, and is reproduced acoustically. The audio reproduced acoustically and emitted from the headphone driver 13 includes the acoustic reproduction component by the audio signal for NC generated at the FF filter 33. Of the audio reproduced acoustically and emitted at the headphone driver 13, the acoustic reproduction component by the audio signal for NC and the noise 18' are synthesized acoustically, thereby reducing (canceling) the noise 18' at the noise cancel point Pc.

The configuration of the FF filter circuit 33 is the same as the FB filter circuit 23, but the difference between both is in that the filter coefficient to be supplied to the digital filter made up of the DSP 332 is for the feedback method or for the feed-forward method.

Figure 7:
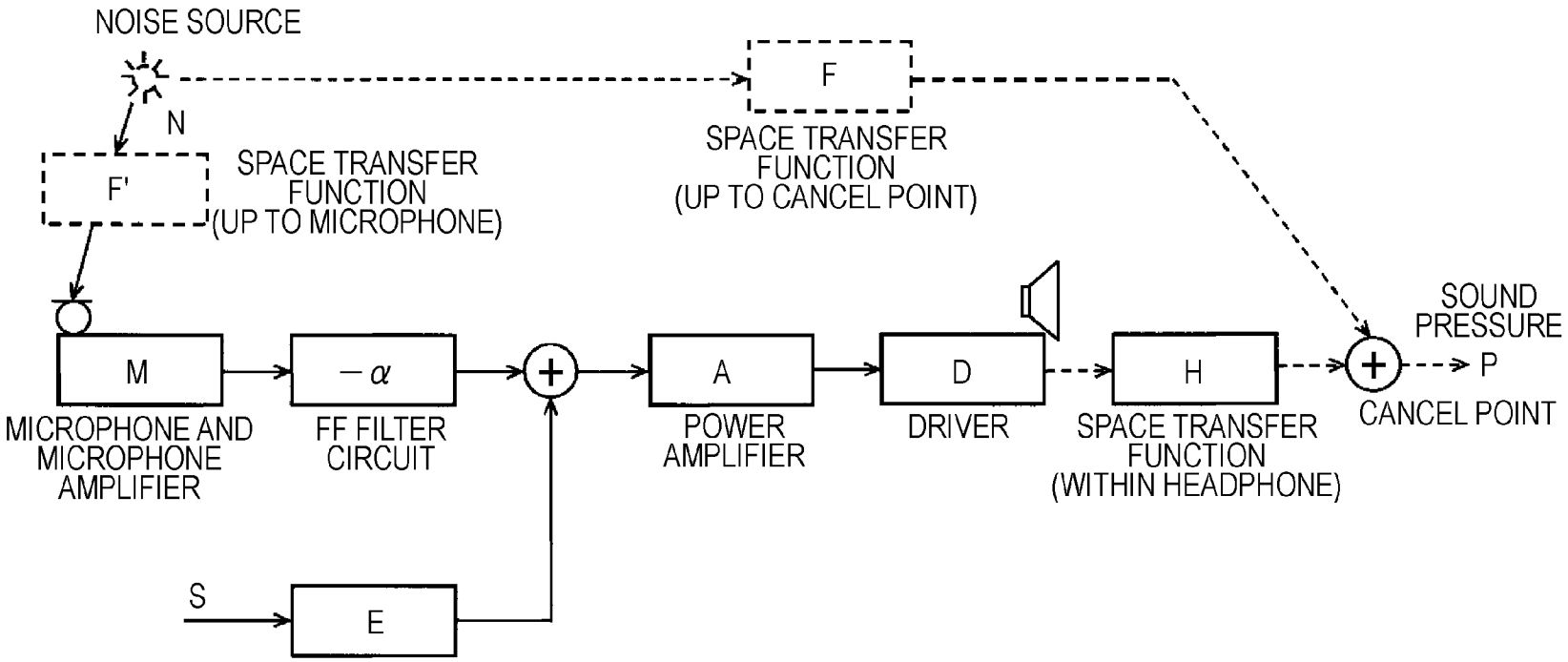
FIG. 7 is an equivalent circuit diagram for describing the noise canceling system in FIG. 6.

Next, the noise canceling operation of the feed-forward NC system will be described by employing transfer functions with reference to FIG. 7. FIG. 7, which corresponds to the block diagram shown in FIG. 6, is a block diagram representing each unit by employing the transfer function thereof.

In FIG. 7, A denotes the transfer function of the power amplifier 17, D denotes the transfer function of the headphone driver 13, M denotes the transfer function corresponding to the portions of the microphone 31 and microphone amplifier 32, and $-\alpha$ denotes the transfer function of a filter designed for feed-forward. Also, H denotes the transfer function of space from the headphone driver 13 to the cancel point Pc, and E denotes the transfer function of an equalizer to be applied to the audio signal S which is a listening target. Also, F denotes the transfer function from the position of the noise N of the external noise source 18 to the position of the cancel point Pc of the ear of the listener.

When representing such as shown in FIG. 7, the block in FIG. 7 can be represented with (Expression 5) in FIG. 4. Note that F' represents the transfer function from the noise source to the microphone position. Let us say that the above-mentioned transfer functions are indicated with complex representation.

Now, when considering an ideal state, if the transfer function F is represented with such as shown in (Expression 6) in FIG. 4, (Expression 5) in FIG. 4 can be represented with (Expression 7) in FIG. 4, wherein the noise is canceled, and only the music signal (or the music signal which is a listening target, or the like) S is left. Thus, it can be found that the listener can listen to the same sound as the sound of common headphone operation even with the NC system in FIG. 6. The sound pressure P at this time is represented such as shown in (Expression 7) in FIG. 4.

However, in reality, a complete filter configuration having transfer functions such that (Expression 6) in FIG. 4 holds completely is difficult. In particular, with regard to middle and high frequencies, the individual difference is great depending on a person's mounting state and ear shape, and the property is changed according to the noise position and microphone position. According to such a reason, usually, with regard to middle and high frequencies, the above-mentioned active noise canceling processing is not performed, and passive sound isolation is frequently preformed at the headphone casing 12.

Note that, (Expression 6) in FIG. 4 means, as can be apparent from the numerical expression, that the transfer functions from the noise source to the ear position are simulated with electric circuits including the transfer function $\alpha$ of the digital filter.

Note that, as shown in FIG. 6, the cancel point with the feed-forward type of the example in FIG. 6 can be set to an arbitrary ear position of the listener, which is different from the feedback type shown in FIG. 2.

However, in a usual case, the $\alpha$ is fixed, and is determined with a certain target property as an object on the design stage. Ear shapes differ depending on the person, and accordingly, sufficient noise cancel effects are not obtained, and a noise component is added with non-reverse phase, and accordingly, a phenomenon occurs such that abnormal noise occurs.

Figure 8:
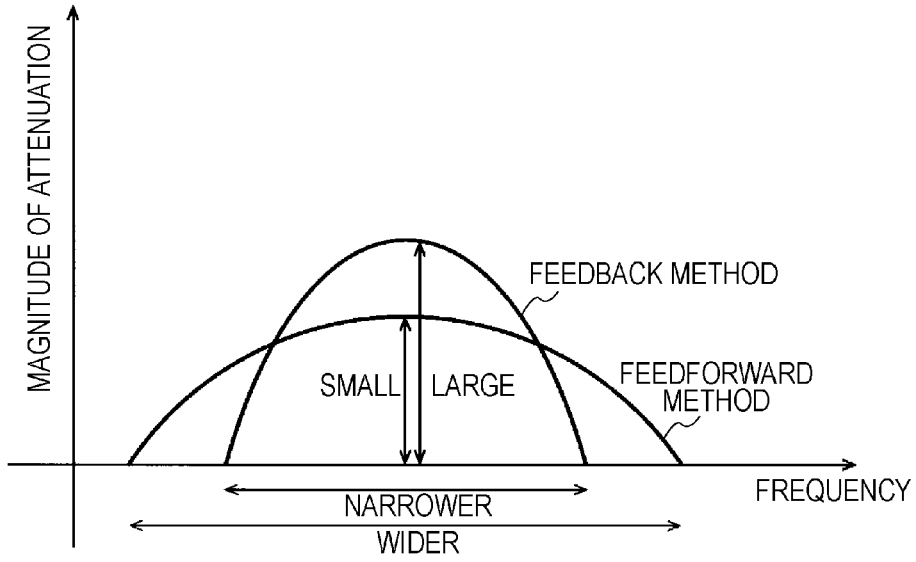
FIG. 8 is a diagram for describing an example of a noise canceling system employed for an embodiment of the present invention.

In general, as shown in FIG. 8, with the feed-forward method, the possibility of oscillating is low, and accordingly, stability is high, but it is difficult to obtain sufficient magnitude of attenuation. On the other hand, with the feedback method, instead of great magnitude of attenuation being able to be expected, the stability in the system is important.

Note that an arrangement may be made wherein the equalizer circuit 15 with the above description is configured within the DSP 332, the audio signal S is converted into a digital signal, and is supplied to the equalizer circuit within the DSP 332.

Note that, description has been made that the FB filter circuit 23 and FF filter circuit 33 have a digital processing circuit configuration, but may have an analog processing circuit configuration.

Description of Embodiments

When attempting to perform noise reduction in the actual audio reproduction environment by the above-mentioned NC technique, an audio signal to be listened to is collected at the microphone serving as an example of an acousto-electric converting unit under the actual noise environment, so the audio signal to be listened to is also reduced by the NC function thereof. With the following embodiments, the audio signal to be listened to which has been reduced by the NC function is subjected to audio emphasis by the NR technique.

First Embodiment

Hardware Configuration Example

FIG. 1 is a block diagram according to a first embodiment of the noise reduction audio reproducing device according to the present invention. The first embodiment is a case where the noise reduction audio reproducing device has been applied to the above-described headphone device. Accordingly, the same portions as those described above are denoted with the same reference numerals. Note that, in order to simplify explanation, FIG. 1 illustrates only a configuration example regarding one channel of two left and right channels. With regard to the other channel as well, the same configuration can be configured in the same way.

The headphone device according to the first embodiment has the configuration of the feed-forward method NC system (FIG. 6). Accordingly, an audio signal including noise collected at the microphone 31 provided in the outside of the headphone casing is supplied to the filter circuit for NC (FF filter circuit) 33 of the feed-forward method.

Subsequently, an audio signal for NC generated at the filter circuit for NC 33 is supplied to the headphone driver 13 through the adding circuit 16 and power amplifier 17. Thus, as described above, with the feed-forward method, noise in the actual audio reproduction listening environment is reduced.

Subsequently, with the first embodiment, for example, during listening to music, audio to be listened to such as conversation audio can be listened to from the headphone driver 13 in a state of putting on the headphones as audio to be listened to comfortably.

With the headphone device according to the first embodiment, an audio monitor button is provided on an operating unit 46. With the first embodiment, during a section wherein the audio monitor button is pressed (referred to as "monitor button ON section"), conversation audio to be listened to or the like is emphasized, and is reproduced acoustically at the headphone driver 13.

Accordingly, with the first embodiment, the audio signal of external audio collected from the microphone amplifier 32 to the microphone 31 is supplied to an NR processing unit 42 through an unnecessary band removal filter 41, and is subjected to audio emphasis.

Subsequently, the audio signal subjected to audio emphasis from the NR processing unit 42 is supplied to the adding circuit 16 through a switch circuit 43 for listening to audio to be listened to regarding a desired listening section alone.

Note that, with the present example, the feed-forward NC technique is employed, so external audio to be listened to can be collected at the microphone 31. Accordingly, the microphone 31 is commonly employed for noise collection with the NC function, and for collection of external audio to be listened to. However, separate microphones may be employed for noise collection with the NC function, and for collection of external audio to be listened to.

The unnecessary band removal filter 41 is for removing an unnecessary band audio component other than an audio component to be listened to, and is not indispensable, may not be provided. With this example, voice audio such as conversation audio is taken as a listening target, so the unnecessary band removal filter 41 has a band-pass filter configuration, for example, with the frequency band of 300 Hz through 3 kHz as a passage band.

With the first embodiment, the NR processing unit 42 performs the NR processing of the above-mentioned SS method. Specifically, the power spectrum of estimated noise is subtracted from the power spectrum of the audio signal from the unnecessary band removal filter 41, thereby reducing noise.

Figure 9:
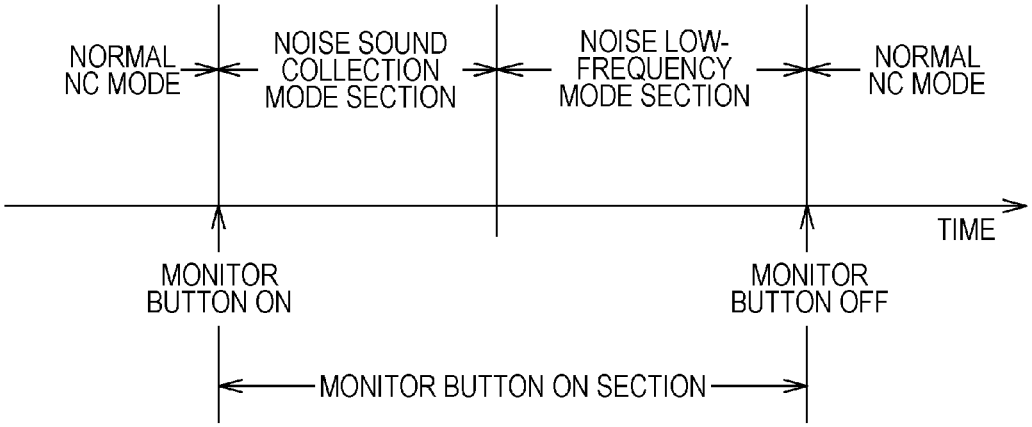
FIG. 9 is a diagram employed for describing the operation of the first embodiment of the noise reduction audio reproducing device according to the present invention.

With the first embodiment, the power spectrum of the noise to be subtracted is taken as the power spectrum of the noise at the time of audio monitoring under the actual audio reproduction environment. Therefore, with the first embodiment, as shown in FIG. 9, the monitor button On section is divided into a noise collection mode section serving as the first partial section, and the subsequent noise reduction mode (NR mode) section.

Length is taken as the length of the noise collection mode section wherein the power spectrum of the noise at the time of audio monitoring under the actual audio reproduction environment is generated, and the generated power spectrum can be stored in the storage unit.

With the noise reduction mode section, the power spectrum of the noise stored in the noise collection mode section immediately before the noise reduction mode section is subtracted from the power spectrum of the audio signal from the unnecessary band removal filter 41, thereby reducing noise to emphasize the audio to be listened to.

A control unit 44 recognizes ON/OFF of the audio monitor button of the operating unit 46 to control processing at the noise collection mode section, and processing at the noise reduction mode section. Specifically, with the noise collection mode section, the control unit 44 controls storing of the power spectrum of the noise as to a noise information storage unit 45. Also, with the noise reduction section, the control unit 44 performs control wherein the power spectrum of the noise is read out from the noise information storage unit 45, and is supplied to the NR processing unit 42 as for subtraction.

Subsequently, the control unit 44 performs control wherein the switch circuit 43 is turned ON only at the noise reduction mode section.

Figure 10:
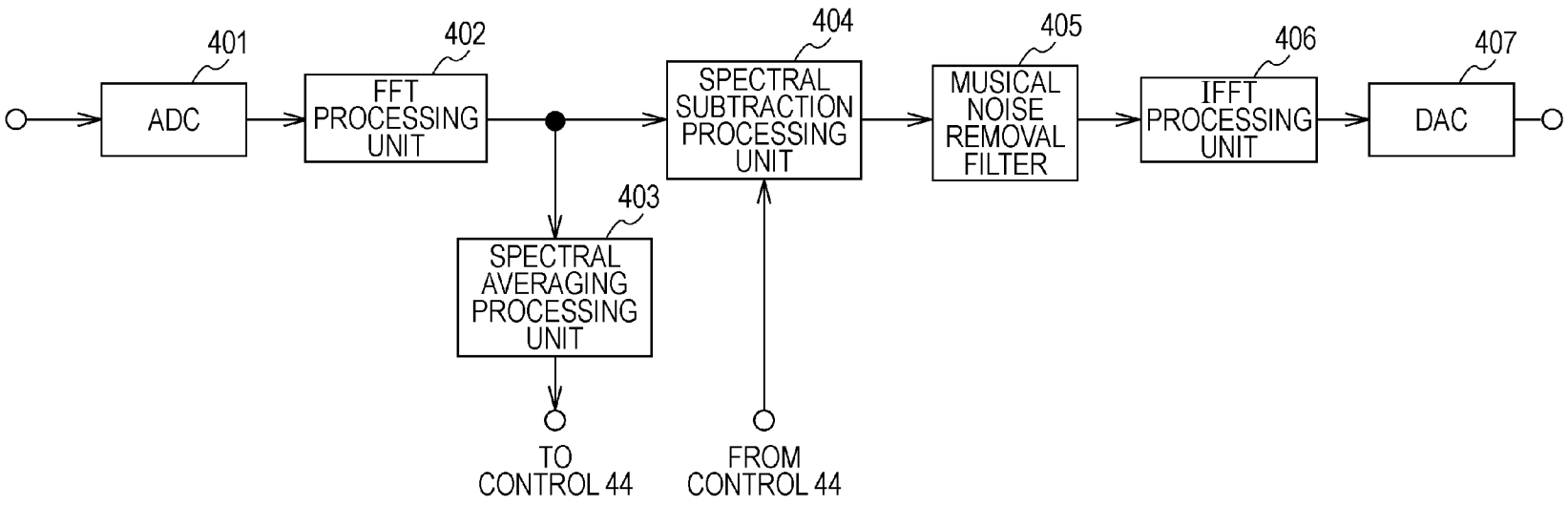
FIG. 10 is a diagram for describing a specific configuration example of a portion of the noise reduction audio reproducing device in FIG. 1.

FIG. 10 illustrates a specific configuration example of the NR processing unit 42 of the present example. Specifically, the audio signal from the unnecessary band removal filer 41 is converted into a digital audio signal at an A/D converter 401, and is then supplied to an FFT (Fast Fourier Transform) processing unit 402, and is subjected to Fourier transform. Subsequently, with the noise collection mode section, each frequency spectrum component from the FFT processing unit 402 is averaged at a spectral averaging processing unit 403 to generate the power spectrum of noise.

Subsequently, with the noise collection mode section, the power spectrum of the noise from the spectral averaging processing unit 403 is transferred to the control unit 44. The control unit 44 stores the power spectrum of the obtained noise in the noise information storage unit 45.

Also, the power spectrum of the audio signal made up of each frequency spectrum from the FFT processing unit 402 is supplied to a spectral subtraction processing unit 404. Subsequently, the control unit 44 reads out the power spectrum of the noise from the noise information storage unit 45 to supply this to the spectral subtraction processing unit 404.

The spectral subtraction processing unit 404 subtracts the power spectrum of the above-mentioned noise from the power spectrum of the audio signal from the FFT processing unit 402. Subsequently, the spectral subtraction processing unit 404 supplies the spectrum of the subtraction result to a musical noise removal filter 405. The musical noise removal filter 405 performs musical noise removal processing from the spectrum of the subtraction result to supply the spectrum after removal thereof to an IFFT (inverse FFT) processing unit 406. The IFFT processing unit 406 returns the spectrum of the subtraction result wherein musical noise has been removed to a digital audio signal serving as a time-series signal.

Subsequently, the IFFT processing unit 406 supplies the digital audio signal to the D/A converter 407. The D/A converter 407 converts the digital audio signal into an analog audio signal, and outputs the analog audio signal thereof to the NR processing unit 42 as an output signal.

Operation of the First Embodiment

As shown in FIG. 9, when the audio monitor button of the operating unit 46 is not pressed, with the device in FIG. 1, the switch circuit 43 is turned off by the control unit 44, which prevents the system of the NR processing unit 42 from activation. Consequently, the noise reduction audio reproducing device (headphone device) according to the first embodiment becomes the normal NC mode wherein the NC function unit alone is active.

In the normal NC mode, external noise is reduced. Subsequently, the audio signal input through the audio signal input terminal 14 is supplied to the headphone driver 13 through the equalizer circuit 15, adding circuit 16, and power amplifier 17, and is reproduced comfortably in a state in which external noise is reduced.

In the state of the normal NC mode, when the user presses the audio monitor button of the operating unit 46 to turn on this to listen to, for example, the voice of the other party, the control unit 44 sets the device according to the first embodiment to the noise collection mode. Subsequently, in this noise collection mode, as described above, the control unit 44 stores the output of the spectral averaging processing unit 403 of the NR processing unit 42 in the noise information storage unit 45 as the power spectrum of noise in an external environment at such point of time.

Upon storing of the power spectrum of the noise to the noise information storage unit 45 being completed, the control unit 44 switches the device according to the first embodiment to the noise reduction mode. In the noise reduction mode, the control unit 44 turns on the switch circuit 43, and also reads out the power spectrum of the noise from the noise information storage unit 45 to supply this to the spectral subtraction processing unit 404 of the NR processing unit 42.

Accordingly, with the NR processing unit 42, the power spectrum of noise is subtracted from the power spectrum of the audio signal collected at the microphone 31 by the spectral subtraction processing unit 404. Subsequently, the subtraction result thereof is supplied to the inverse FFT processing unit 406 through the musical noise removal filter 405, and is converted into a digital audio signal which is a temporal axis signal. The digital audio signal thereof is converted into an analog audio signal by the D/A converter 407, and is supplied to the adding circuit 16 through the switch circuit 43, and is added to the audio signal for NC and the audio signal from the equalizer circuit 15. This addition signal is supplied to the headphone driver 13 through the power amplifier 17, and is reproduced acoustically.

The audio emphasis operation in the noise reduction mode will be described further with reference to the frequency property diagrams in FIG. 11 through FIG. 13.

Figure 11:
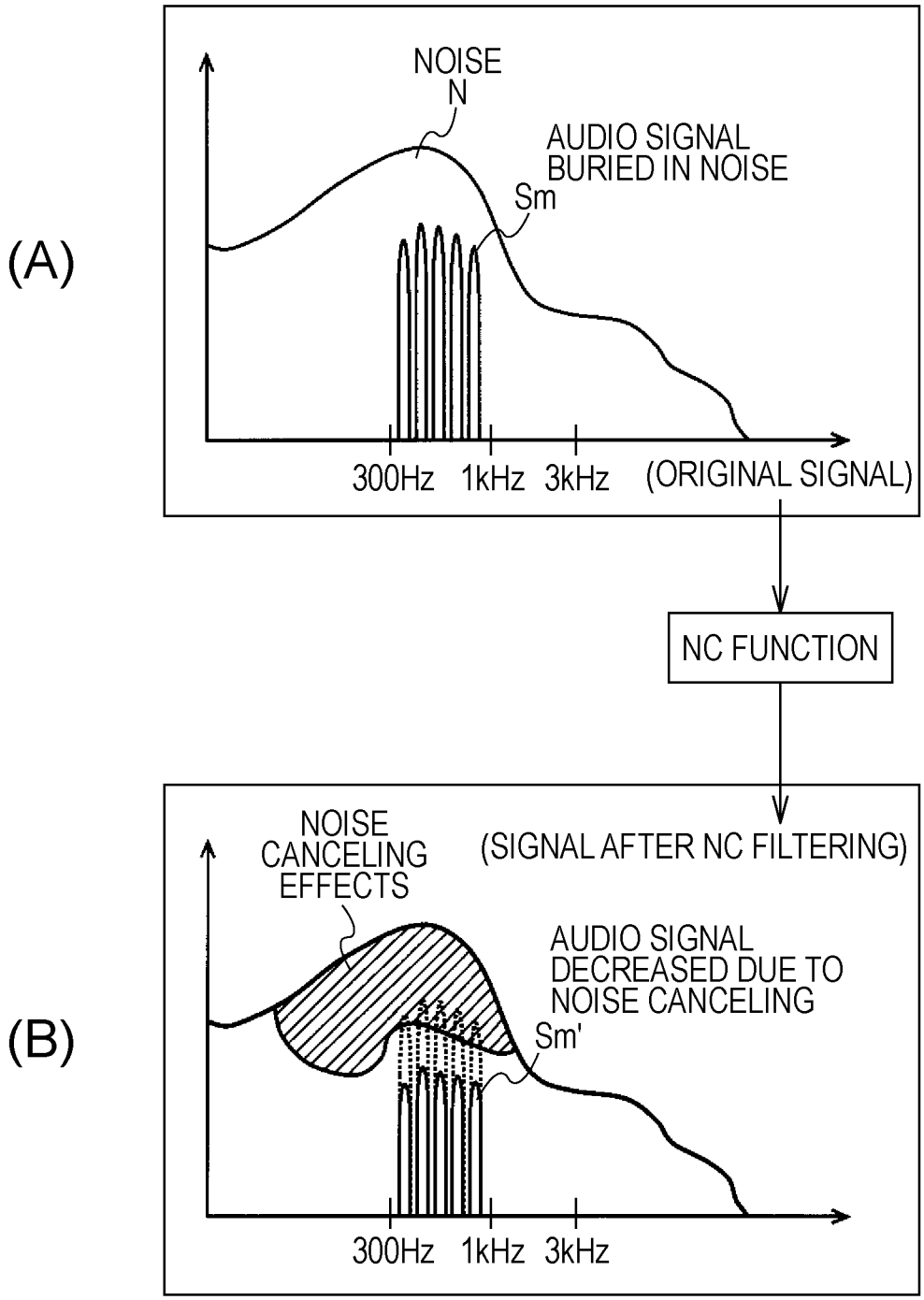
FIG. 11 is a diagram employed for describing the operation effects of the first embodiment of the noise reduction audio reproducing device according to the present invention.
Figure 12:
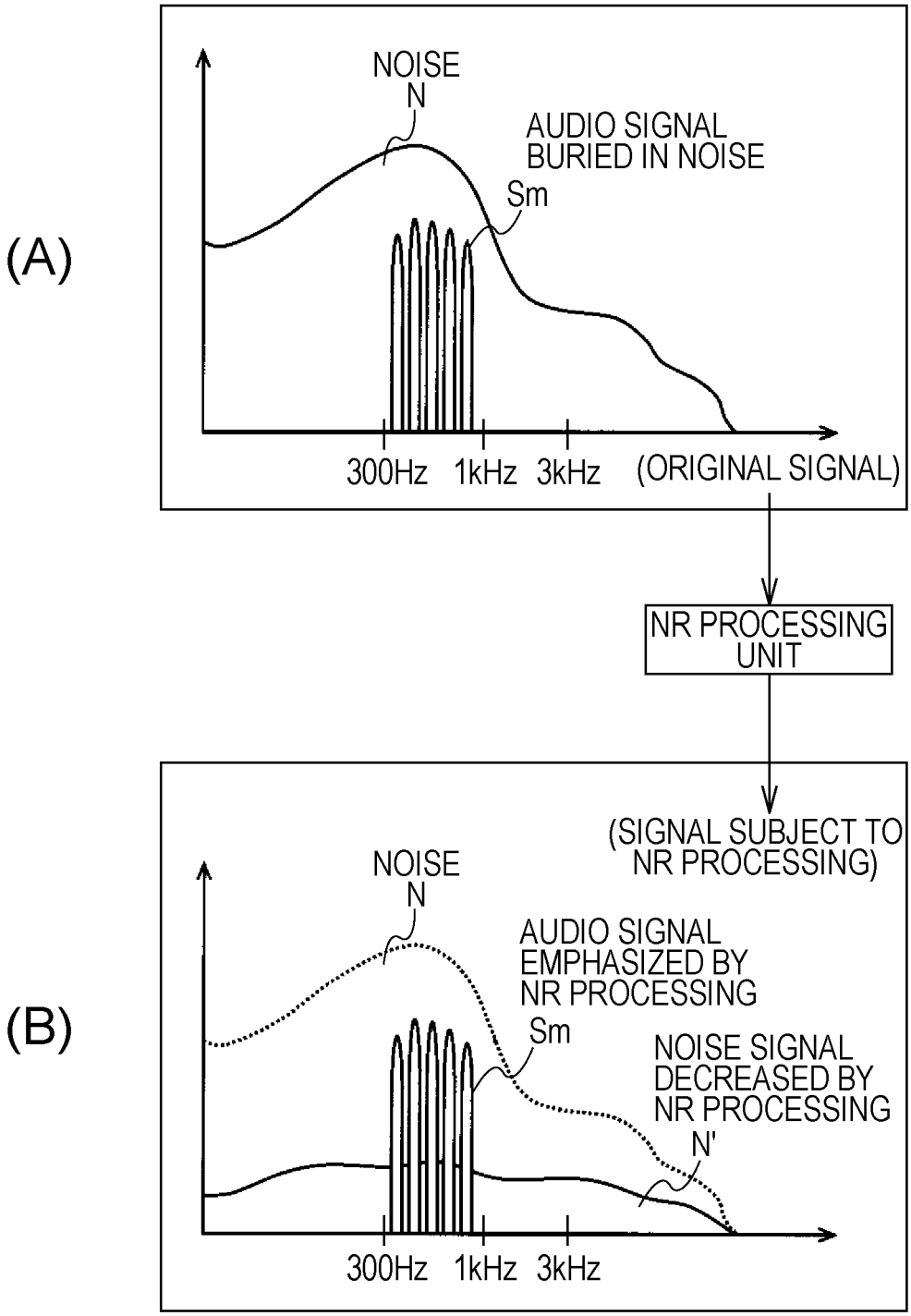
FIG. 12 is a diagram employed for describing the operation effects of the first embodiment of the noise reduction audio reproducing device according to the present invention.
Figure 13:
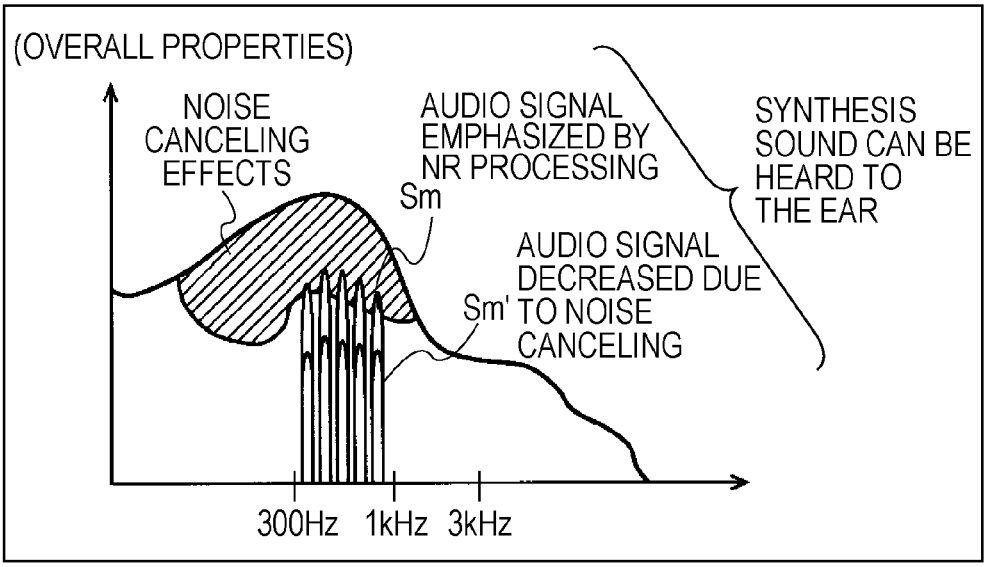
FIG. 13 is a diagram employed for describing the operation effects of the first embodiment of the noise reduction audio reproducing device according to the present invention.

Now, let us assume a case where external environmental audio in the noise reduction mode is, for example, such as (A) in FIG. 11 and (A) in FIG. 12. With (A) in FIG. 11 and (A) in FIG. 12, the external environment is a noise environment, the noise level is high, and a voice audio signal Sm of the other party is in a state of being obscured by noise N. Note that (A) in FIG. 11 and (A) in FIG. 12 are completely the same diagrams.

In such an external environment, with the noise reduction audio reproducing device according to the first embodiment, noise is reduced by the noise canceling effects of the NC function such as shown in a shaded portion in (B) in FIG. 11. However, at this time, the audio signal Sm to be listened to also becomes an audio signal Sm' reduced such as shown in a solid line in (B) in FIG. 11.

On the other hand, with the NR processing unit 42, the noise N of the external environment shown in (A) in FIG. 12 is reduced such as shown in the noise N' in a solid line in (B) in FIG. 12, and the audio signal Sm to be listened to is subjected to audio emphasis.

Subsequently, with the adding circuit 16, as shown in (B) in FIG. 11, the audio signal Sm' reduced by the noise cancel effects, and the audio signal Sm of which the noise has been reduced and subjected to audio emphasis as shown in (B) in FIG. 12 are added. Consequently, as shown in FIG. 13, the synthesis signal of the audio signal Sm' reduced by the noise cancel effects, and the audio signal Sm subjected to audio emphasis by the NR processing unit 42 is emphasized as compared to the noise subjected to noise cancel and reduced.

Accordingly, the acoustic reproduced sound from the headphone driver 13 becomes the synthesis sound of the audio signal Sm' and the audio signal Sm audio-emphasized by the NR processing unit 42, whereby the listener can listen to the audio signal Sm with improvement in audio clarity.

Second Embodiment

With the above-mentioned first embodiment, the NC processing system and the NR processing unit 42 are provided in parallel as to the audio signal from the microphone 31. That is to say, an arrangement is made wherein the audio signal from the microphone 31 is supplied to the filter circuit for NC 33, and is also supplied to the NR processing unit 42 through the unnecessary band removal filter 41.

Figure 14:
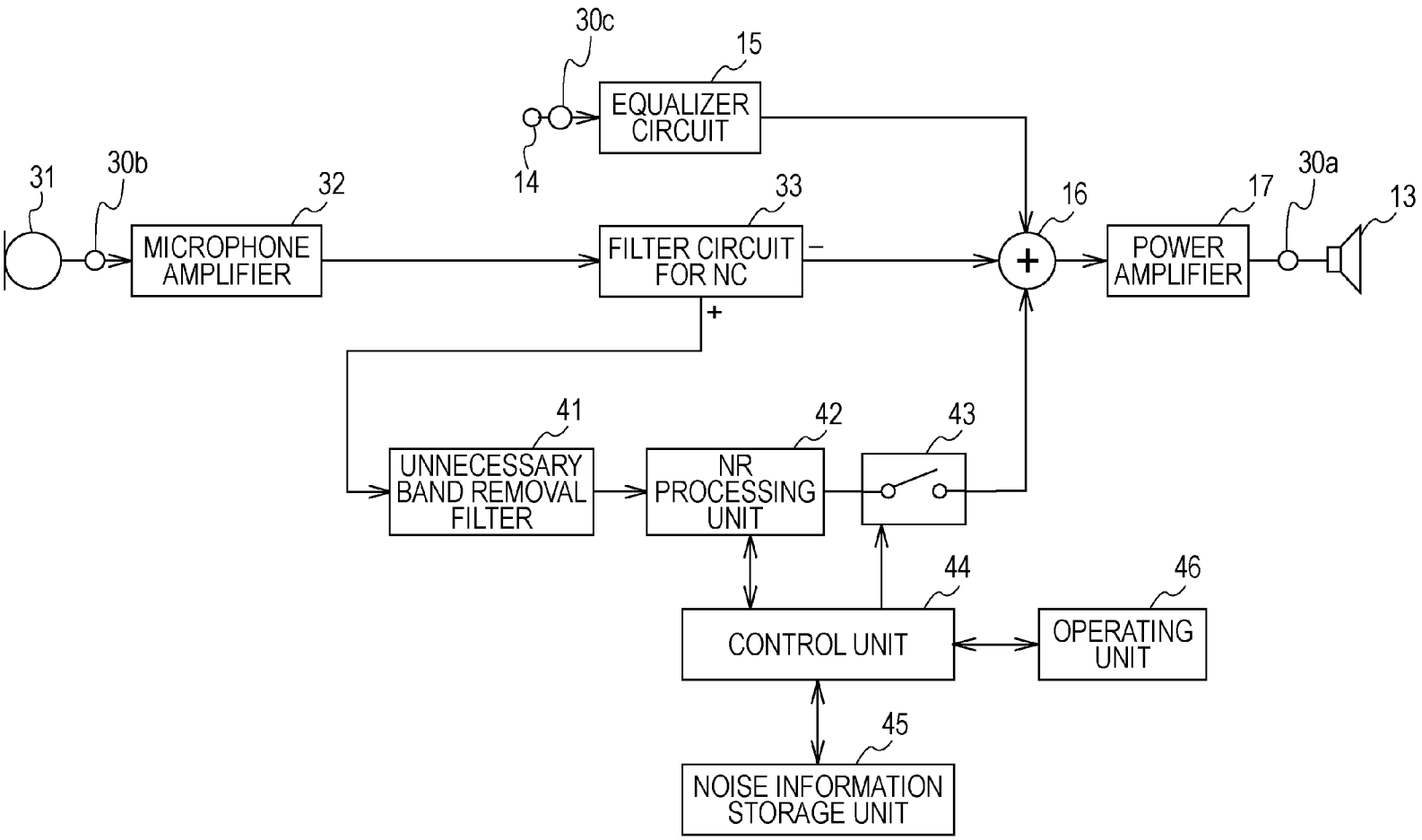
FIG. 14 is a block diagram illustrating a hardware configuration example of a second embodiment of the noise reduction audio reproducing device according to the present invention.

On the other hand, with the second embodiment, as shown in FIG. 14, the output signal of the inverse phase of the audio signal for NC from the filter circuit for NC 33 is supplied to the unnecessary band removal filter 41. Here, the output signal of the inverse phase of the audio signal for NC is the inverse phase signal of the noise cancel signal, so includes the noise and voice signal collected at the microphone 31 in the same phase. The others are configured in the same way as with the above-mentioned first embodiment.

That is to say, with the second embodiment, the audio signal included in the inverse phase signal of the audio signal for NC from the filter circuit for NC 33 is subjected to unnecessary band removal at the unnecessary band removal filter 41, and is then audio-emphasized by the NR processing unit 42. Subsequently, in the noise reduction mode, the audio-emphasized audio signal thereof is added to the audio signal for NC at the adding circuit 16 through the switch circuit 43.

Note that, with the second embodiment, in the noise collection mode, the power spectrum of the noise included in the inverse phase signal of the audio signal for NC from the filter circuit for NC 33 is stored in the noise information storage unit 45 by the control unit 44. Subsequently, the power spectrum of the stored noise is, in the same way as with the above-mentioned first embodiment, in the noise reduction mode, supplied to the NR processing unit 42, and is employed for the SS-method processing.

Operation of the Second Embodiment

With the second embodiment as well, the noise collection mode is active at the first section of the pressing section of the audio monitor button, and the noise reduction mode is active at the subsequent section thereof, thereby performing audio emphasis, which is completely the same as with the first embodiment.

The audio emphasis operation in the noise reduction mode with the second embodiment differs from the case of the first embodiment. The audio emphasis operation in the noise reduction mode with the second embodiment will be described with reference to the frequency property diagrams in FIG. 11, FIG. 15, and FIG. 16.

With the second embodiment as well, let us assume a case where the external environment is a noise environment such as shown in (A) in FIG. 11, the noise level is high, and the voice audio signal Sm of the other party is in a state of being obscured by noise N.

Figure 15:
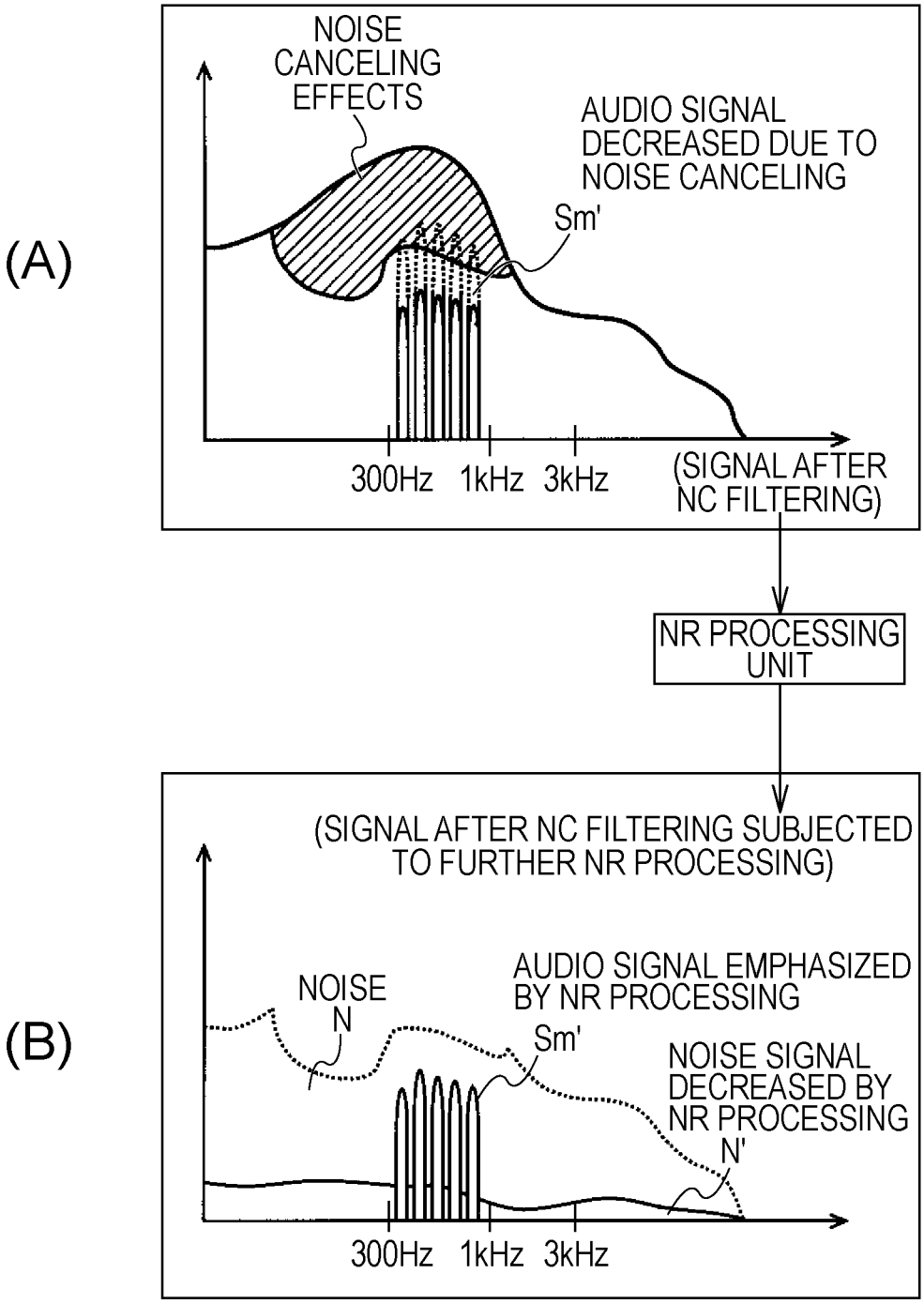
FIG. 15 is a diagram employed for describing the operation effects of the second embodiment of the noise reduction audio reproducing device according to the present invention.

In such an external environment, with the noise reduction audio reproducing device according to the second embodiment as well, noise is reduced by the noise canceling effects of the NC function such as shown in a shaded portion in (B) in FIG. 11 and (A) in FIG. 15. Note that (B) in FIG. 11 and (A) in FIG. 15 are completely the same diagrams. Subsequently, at this time, the audio signal Sm to be listened to also becomes an audio signal Sm' reduced such as shown in a solid line in (B) in FIG. 11 and (A) in FIG. 15.

With the second embodiment, the inverse phase signal of the audio signal for NC such that the NC effects such as shown in (B) in FIG. 11 and (A) in FIG. 15 are obtained is subjected to noise reduction by the SS method at the NR processing unit 42, whereby audio emphasis is performed. The frequency property diagram of the audio signal of the processing result of the NR processing unit 42 is shown in (B) in FIG. 15. That is to say, according to the NR processing, the noise is reduced such as shown in a solid line in (B) in FIG. 15, and accordingly, the audio signal Sm' is emphasized.

Subsequently, with the adding circuit 16, the audio signal for NC from the filter circuit for NC 33, and the emphasized audio signal from the NR processing unit 42 are added, and the audio signal of the addition result thereof is supplied to the headphone driver 13 through the power amplifier 17, and is reproduced acoustically.

Figure 16:
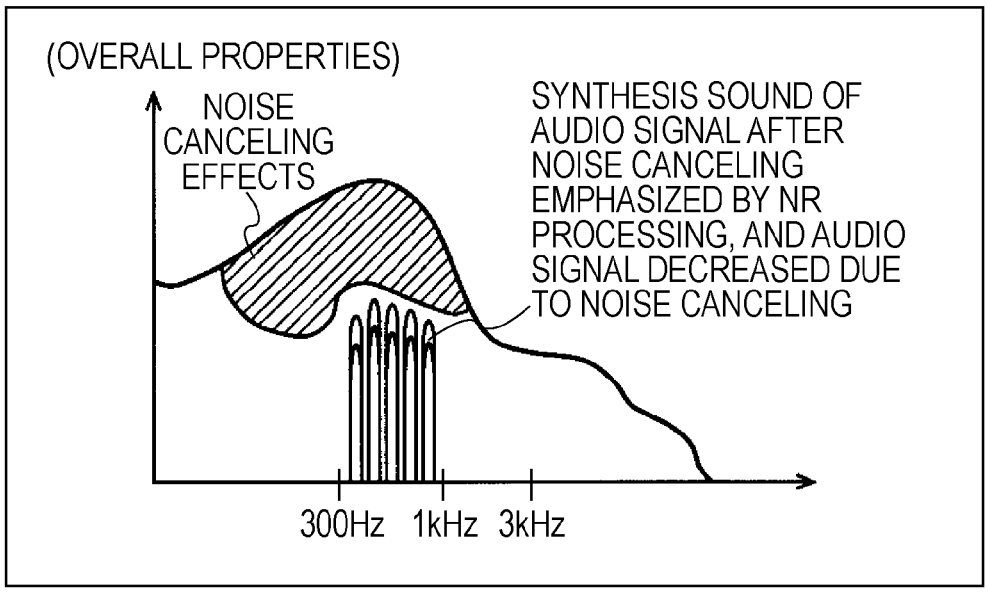
FIG. 16 is a diagram employed for describing the operation effects of the second embodiment of the noise reduction audio reproducing device according to the present invention.

Accordingly, in the case of the second embodiment, as shown in FIG. 16, the audio-emphasized audio signal Sm' is added to the audio signal Sm' reduced by the NC function, and the synthesis sound of both is provided to the listener. Accordingly, the listener can listen to the audio signal Sm with improvement in audio clarity.

Third Embodiment

The above-mentioned first and second embodiments may be configured of a monaural configuration, but the third embodiment is the case of a noise reduction audio reproducing device configured of two-channel stereo of left and right channels.

Figure 17:
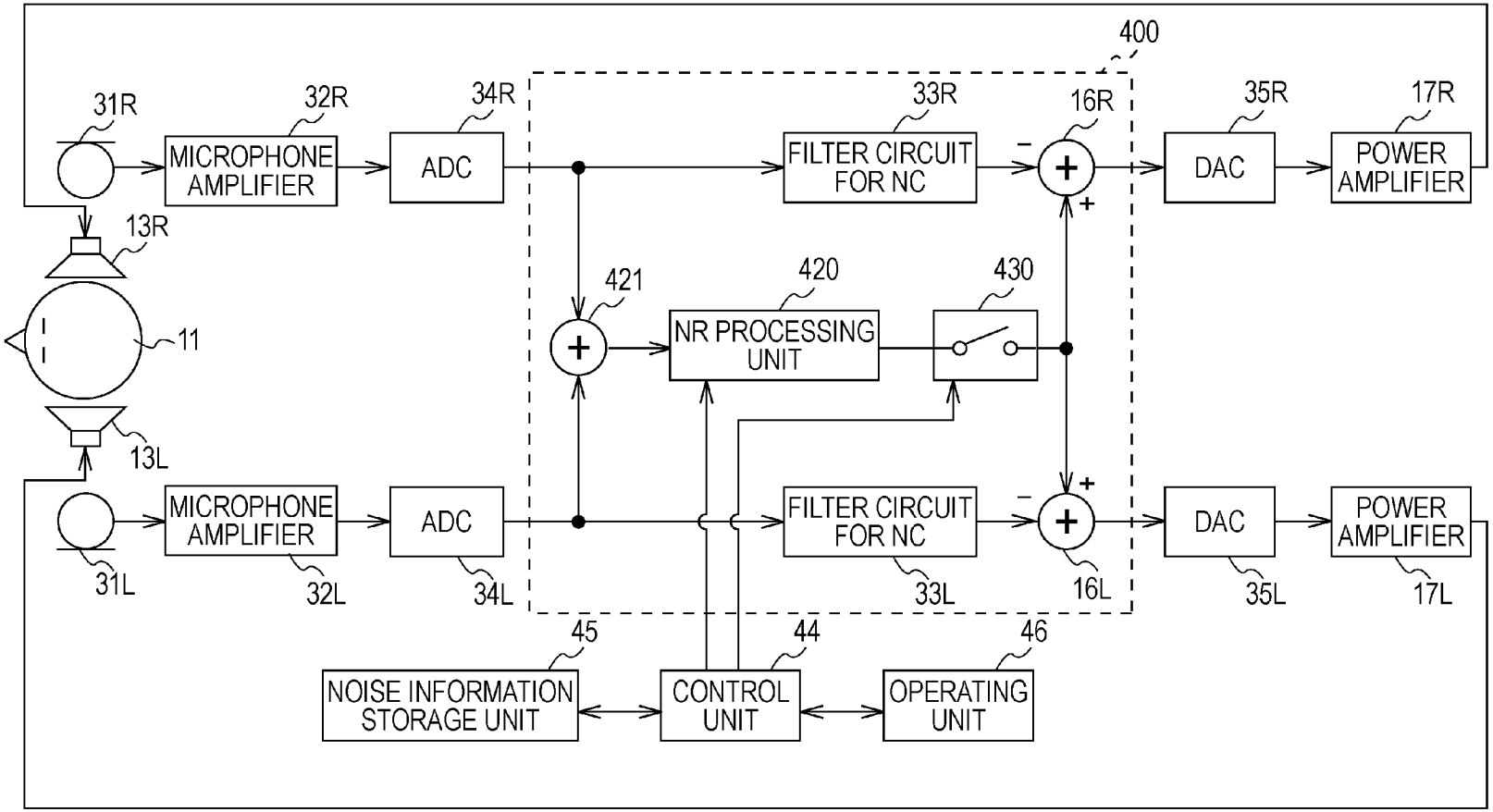
FIG. 17 is a block diagram illustrating a hardware configuration example of a third embodiment of the noise reduction audio reproducing device according to the present invention.

FIG. 17 illustrates a block diagram of a hardware configuration example of the noise reduction audio reproducing device according to the third embodiment. The example of FIG. 17 is a configuration example of a stereo headphone device. As shown in FIG. 17, the noise reduction audio reproducing device according to the present embodiment includes headphone drivers 13L and 13R for the left and right ears. Though not shown in the drawing, these headphone drivers 13L and 13R are provided within the headphone casings. Also, with the third embodiment, microphones 31L and 31R are provided on the outer side of the headphone casings for the left and right ears, respectively.

Subsequently, the audio signals collected and obtained at the microphones 31L and 31R are supplied to A/D converters 34L and 34R through the microphone amplifiers 32L and 32R respectively, and are converted into digital audio signals.

With the third embodiment, the NC processing unit and NR processing unit are realized as a function configuration unit within a single DSP (Digital Signal Processor) 400. Therefore, the digital audio signals from the A/D converters 34L and 34R are input to the DSP 400.

With the DSP 400, the digital audio signals from the A/D converters 34L and 34R are supplied to filter circuits for NC 33L and 33R, respectively. The filter circuits for NC 33L and 33R have the same configuration as the filter circuit for NC 33 according to the above-mentioned first and second embodiments, and generate audio signals for NC for the left and right channels.

The audio signal for NC for the left and right channels from the filter circuits for NC 33L and 33R are supplied to adding circuits 16L and 16R, respectively.

Also, with the third embodiment, the digital audio signals from the A/D converters 34L and 34R are synthesized at a synthesizing unit 421, and are then supplied to an NR processing unit 420 provided commonly as to the two left and right channels. The NR processing unit 420 has the same configuration as the NR processing unit 42 according to the above-mentioned first and second embodiments, and performs the NR processing by the SS method.

The audio signal from the NR processing unit 420 is supplied to the adding circuits 16L and 16R through a switch circuit 430, which are added to the audio signals for NC from the filter circuits for NC 33L and 33R.

Subsequently, the digital audio signals from the adding circuits 16L and 16R are supplied to D/A converters 35L and 35R as the output signals of the DSP 400, respectively. Subsequently, the digital audio signals are converted into analog audio signals at the D/A converters 35L and 35R, and the analog audio signals thereof are supplied to headphone drivers 13L and 13R for the left and right ears through power amplifiers 17L and 17R, respectively.

As with the above-mentioned first and second embodiments, the control unit 44, noise information storage unit 45, and operating unit 46 including the audio monitor button are also provided with the third embodiment.

Also, with the third embodiment as well, the first section of the section where the audio monitor button is turned on (monitor button ON section) is taken as a noise collection mode section, and the subsequent section thereof is taken as a noise reduction mode section (see FIG. 9).

In the same way as with the case of the above-mentioned embodiment, with the third embodiment as well, the control unit 44 obtains the power spectrum of the noise from the NR processing unit 420 at the noise collection mode section, and stores this in the noise information storage unit 45. Subsequently, the control unit 44 reads out the power spectrum of the noise stored in the noise information storage unit 45 to supply this to the NR processing unit 420 at the noise reduction mode section, and also turns on the switch circuit 430 at this noise reduction mode section alone. The audio emphasis operation at the audio monitor button ON section with the third embodiment is the same as that in the case described in the first embodiment.

As described above, with the third embodiment, upon pressing the audio monitor button of the operating unit 46, the listener can listen to conversation audio or the like collected at the microphones 13L and 13R in a clear manner at the audio monitor pressing section.

Note that, with the example in FIG. 17, an arrangement has been made wherein the digital signals from the A/D converters 34L and 34R are synthesized, and is then supplied to the NR processing unit 420, but an arrangement may be made wherein only the digital audio signal of one of the left and right channels is supplied to the NR processing unit 420.

However, in a case where a generating source of audio to be listened to in an emphasis manner is positioned in the front of the user (listener), it is desirable to synthesize the digital signals from the A/D converters 34L and 34R are synthesized, and then supply this to the NR processing unit 420. This is because the S/N of the audio signal can be increased, and also with the NR processing unit, in a case where a completely different band signal is subtracted at the left and right channels, uncomfortable feeling between the left and right channels can be decreased. Usually, in the case of talking with someone, it can be conceived that the other party is positioned in front, so the embodiment in FIG. 17 can be taken as an appropriate example.

Note that the NR processing may be executed by taking advantage of the stereo microphone and audio at the front position, and also by employing a technique such as independent component analysis (ICA) employed for sound source separation technique, or the like.

Also, with the example in FIG. 17, the first embodiment has been applied to audio emphasis regarding stereo audio signals, but the second embodiment may be applied thereto as well. In this case, the output signal of the filter circuit for NC 33L, and the output signal of the filter circuit for NC 33R may be synthesized to supply this to the NR processing unit 420, or one of the output signals of the filter circuit for NC 33L or 33R may be supplied to the NR processing unit 420.

Note that, though not shown in the FIG. 17, in the case of listening to a music signal by headphones, the audio signals of the left and right channels of the music signal should be added to the audio signals from the D/A converters 35L and 35R, respectively, as with the first and second embodiments.

Fourth Embodiment

The fourth embodiment is the case of a noise reduction audio reproducing device configured of two-channel stereo of left and right channels, in the same way as with the third embodiment. The fourth embodiment differs from the third embodiment in that an audio emphasis circuit having a different configuration from the NR processing unit 420 employing the SS method is employed.

Figure 18:
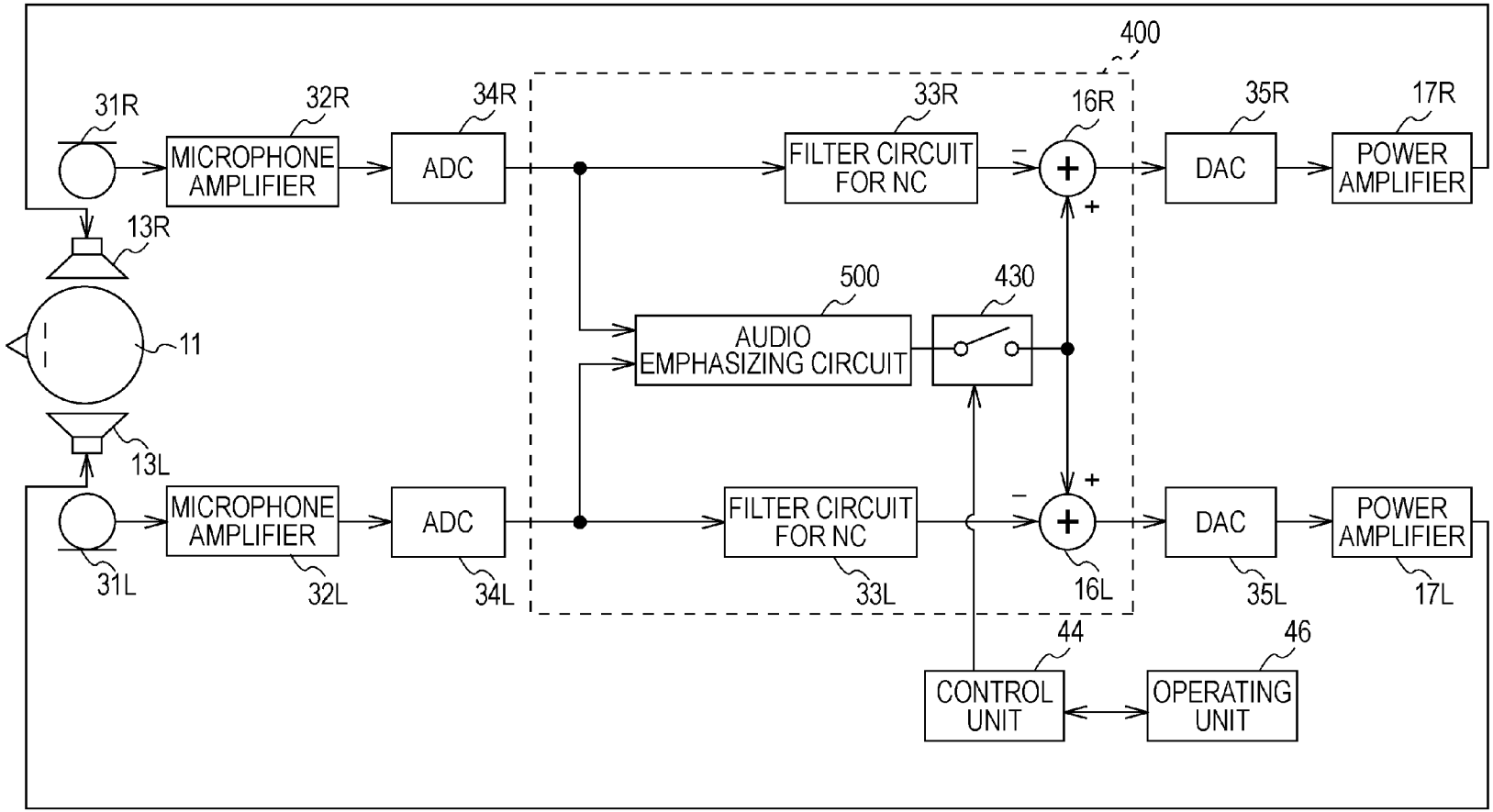
FIG. 18 is a block diagram illustrating a hardware configuration example of a fourth embodiment of the noise reduction audio reproducing device according to the present invention.

FIG. 18 illustrates a block diagram of a hardware configuration example of a noise reduction audio reproducing device according to the fourth embodiment. The example in FIG. 18 is a configuration example of a stereo headphone device.

With the fourth embodiment, as shown in FIG. 18, the digital audio signals from the A/D converters 34L and 34R are supplied to an audio emphasis circuit 500 provided within the DSP 400. Subsequently, the audio-emphasized audio signal from the audio emphasis circuit 500 is supplied to the adding circuits 16L and 16R through the switch circuit 430.

Figure 19:
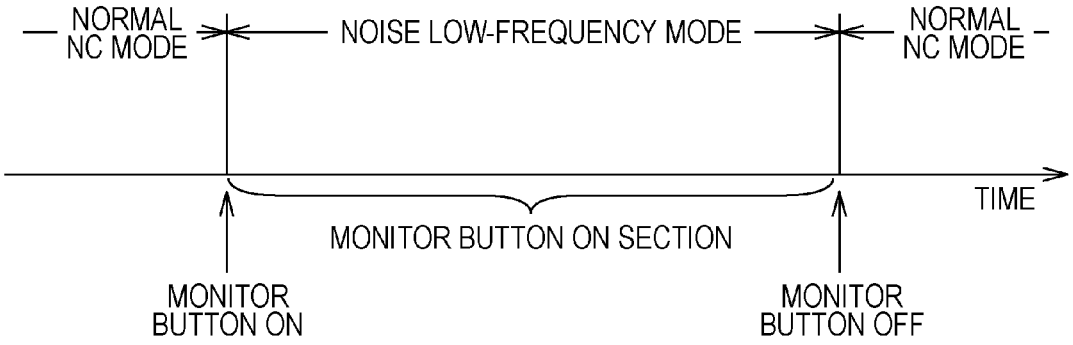
FIG. 19 is a diagram employed for describing the operation of the fourth embodiment of the noise reduction audio reproducing device according to the present invention.

The audio emphasis circuit 500 according to the fourth embodiment does not employ a configuration wherein the NR processing by the SS method is performed, as described later, the noise collection mode can be omitted. Accordingly, with the fourth embodiment, the noise information storage unit 45 is not provided. Upon the audio monitor button of the operating unit 46 being pressed, as shown in FIG. 19, the control unit 44 immediately switches to the noise reduction mode from the normal NC mode, and continues the noise reduction mode thereof during the section wherein the audio monitor button is ON. Subsequently, upon the audio monitor button being turned off, the control unit 44 switches to the normal NC mode from the noise reduction mode.

Accordingly, upon detecting ON by the pressing of the audio monitor button of the operating unit 46, the control unit 44 sets the switch circuit 430 to ON to proceed to a mode emphasizing the audio signal collected at the microphone 31.

The other configurations are completely the same as those in the third embodiment, so description thereof will be omitted.

Figure 20:
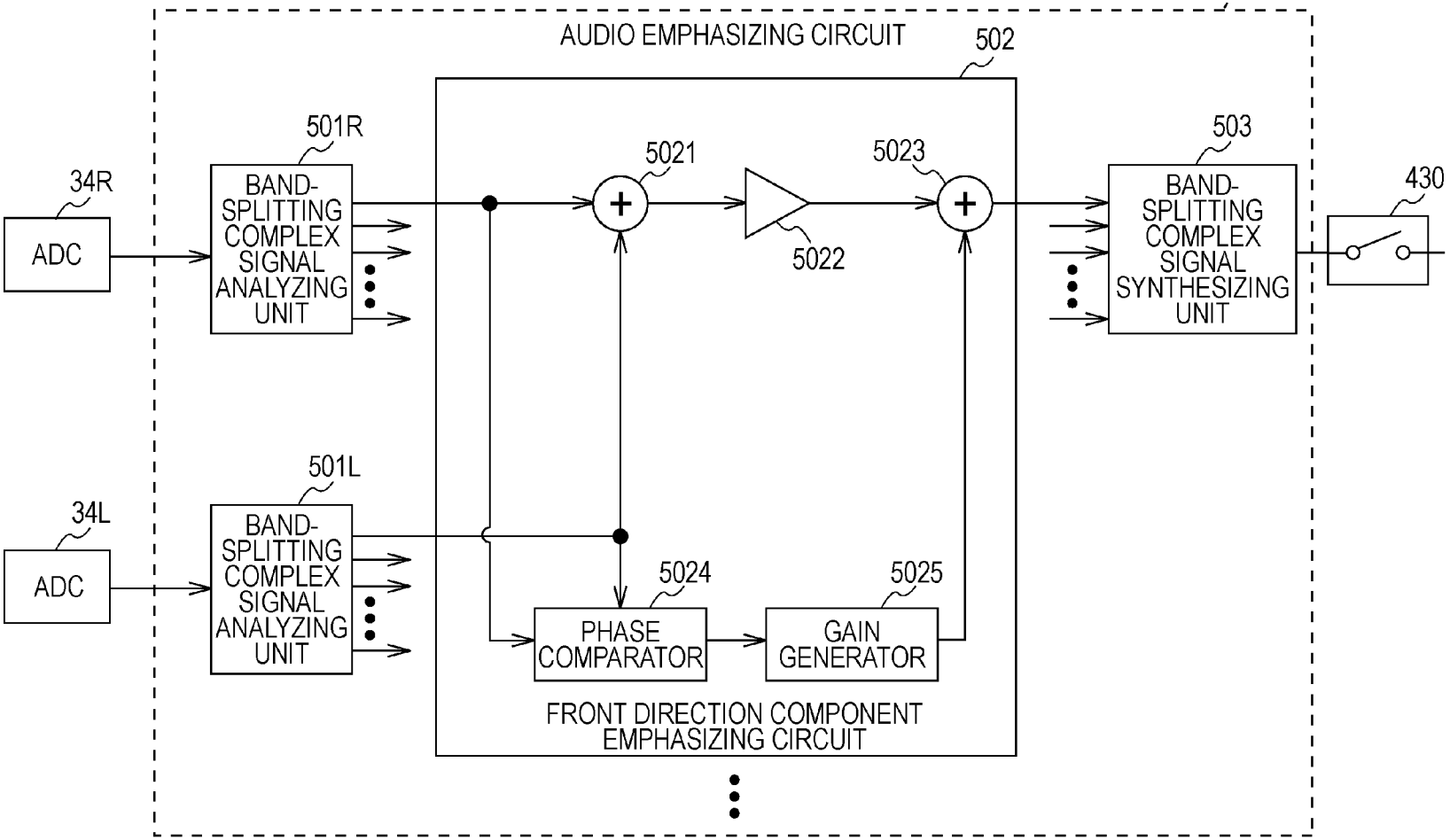
FIG. 20 is a block diagram illustrating a configuration example of the principal components of the fourth embodiment of the noise reduction audio reproducing device according to the present invention.

Next, a hardware configuration example of the audio emphasis circuit 500 according to the fourth embodiment is illustrated in FIG. 20. The digital audio signals from the A/D converters 34L and 34R are supplied to band-splitting complex signal analyzing units 501L and 501R, respectively. Each of the band-splitting complex signal analyzing units 501L and 501R is, for example, a circuit unit for obtaining the audio signal (complex signal) for each divided band obtained by dividing an audio signal band into multiple frequency bands.

Each of the band-splitting complex signal analyzing units 501L and 501R can be configured of, for example, multiple complex band-pass filters for obtaining the signal for each divided band. Alternatively, an arrangement may be made wherein frequency spectrum signals obtained by the FFT processing are collected for each divided band, thereby obtaining synthesis output or average output thereof.

The complex signal components for each same divided band from the band-splitting complex signal analyzing units 501L and 501R are each supplied to a front direction component emphasizing circuit 502. FIG. 20 illustrates only one front direction component emphasizing circuit 502, but in reality, the number of the front direction component emphasizing circuit 502 is equal to the number of divided bands, and the complex signal components for each same divided band from the band-splitting complex signal analyzing units 501L and 501R are each supplied to each front direction component emphasizing circuit 502.

The front direction component emphasizing circuit 502 is configured of an adder 5021, amplifier 5022, gain multiplier 5023, phase comparator 5024, and gain generator 5025.

The complex signals of the same divided band from the band-splitting complex signal analyzing units 501L and 501R are added at the adder 5021, which is then supplied to the gain multiplier 5023 through the amplifier 5022. Also, the complex signals of the same divided band from the band-splitting complex signal analyzing units 501L and 501R are supplied to the phase comparator 5024 to perform phase comparison.

With the fourth embodiment, in the same way as with the third embodiment, conversation audio is emphasized as audio to be listened to. Therefore, with the fourth embodiment, the gain is increased regarding the audio signals of the left and right channels with the frequency components which become the same phase as the audio signal components from the front direction.

The phase comparator 5024 compares the phases of the complex signals of the same divided band from the band-splitting complex signal analyzing units 501L and 501R to determine whether the phases of the left and right channels are matched or approximated so as to determine as matched. Subsequently, in a case where determination can be made that the phases of the left and right channels are matched or approximated so as to determine as matched, a multiplication coefficient (gain value) to be supplied to the multiplier 5023 from the gain generator 5025 is increased as compared to the other divided band components.

The multiplication coefficient (gain value) from the gain generator 5025 is supplied to the gain multiplier 5023. Subsequently, with the gain multiplier 5023, the audio signal from the amplifier 5022 is multiplied by the gain value from the gain generator 5025. Subsequently, the audio signal (complex signal) multiplied by the gain value from the gain multiplier 5023 is supplied to a band-splitting complex signal synthesizing unit 503.

The band-splitting complex signal synthesizing unit 503 synthesizes the audio signal (complex signal) from the front direction component emphasizing unit 502 for each divided band. In a case where the band-splitting complex signal analyzing units 501L and 501R include a FFT processing unit, the band-splitting complex signal synthesizing unit 503 includes an IFFT (inverse FFT) processing unit.

Subsequently, the frequency synthesis signal from the band-splitting complex signal synthesizing unit 503 is supplied to the adding circuits 16L and 16R through the switch circuit 430.

According to the fourth embodiment, with the audio emphasizing circuit 500, the audio signal from the other party from the front direction as to the listener 11 is audio-emphasized. Accordingly, the audio monitor button is operated to ON, whereby the listener can listen to conversation audio in an articulate listenable state even under a noise environment.

Note that, with the fourth embodiment, in order to emphasize only the audio signal in the front direction, an arrangement has been made wherein the frequency component which becomes the same phase at the left and right channels is detected at the phase comparator 5024, and the gain regarding the frequency component thereof is increased. However, in a case where, for example, an oblique direction such as a left oblique 45-degree direction, right oblique 45-degree direction, or the like is taken as a determination direction instead of the front direction, and the frequency component in such a direction is emphasized, the phase difference of the audio signals in such an oblique direction at the left and right channels should be detected at the phase comparator 5024.

Also, a so-called array microphone made up of multiple microphones is employed as the microphones 31L and 31R instead of a single microphone, whereby only the audio signal with an incident direction as the determination direction can also be collected at the array microphone.

Note that the band-splitting complex signal analyzing units 501L and 501R may be configured so as to employ a poly phase filter or QMF (Quadrature Mirror Filter; 4-phase mirror image dividing filter).

Fifth Embodiment

With the noise reduction audio reproducing devices according to the above-mentioned first through fourth embodiments, the feed-forward NC processing system has been employed as the NC processing system. However, the feedback NC processing system may be employed as the NC processing system wherein the microphone is provided within a headphone casing. However, in this case, the microphone serving as a collecting unit of an audio signal input to the NR processing units 42 and 420, and audio emphasizing circuit 500 does not serve as the NC processing system, and is provided separately outside a headphone casing.

Figure 21:
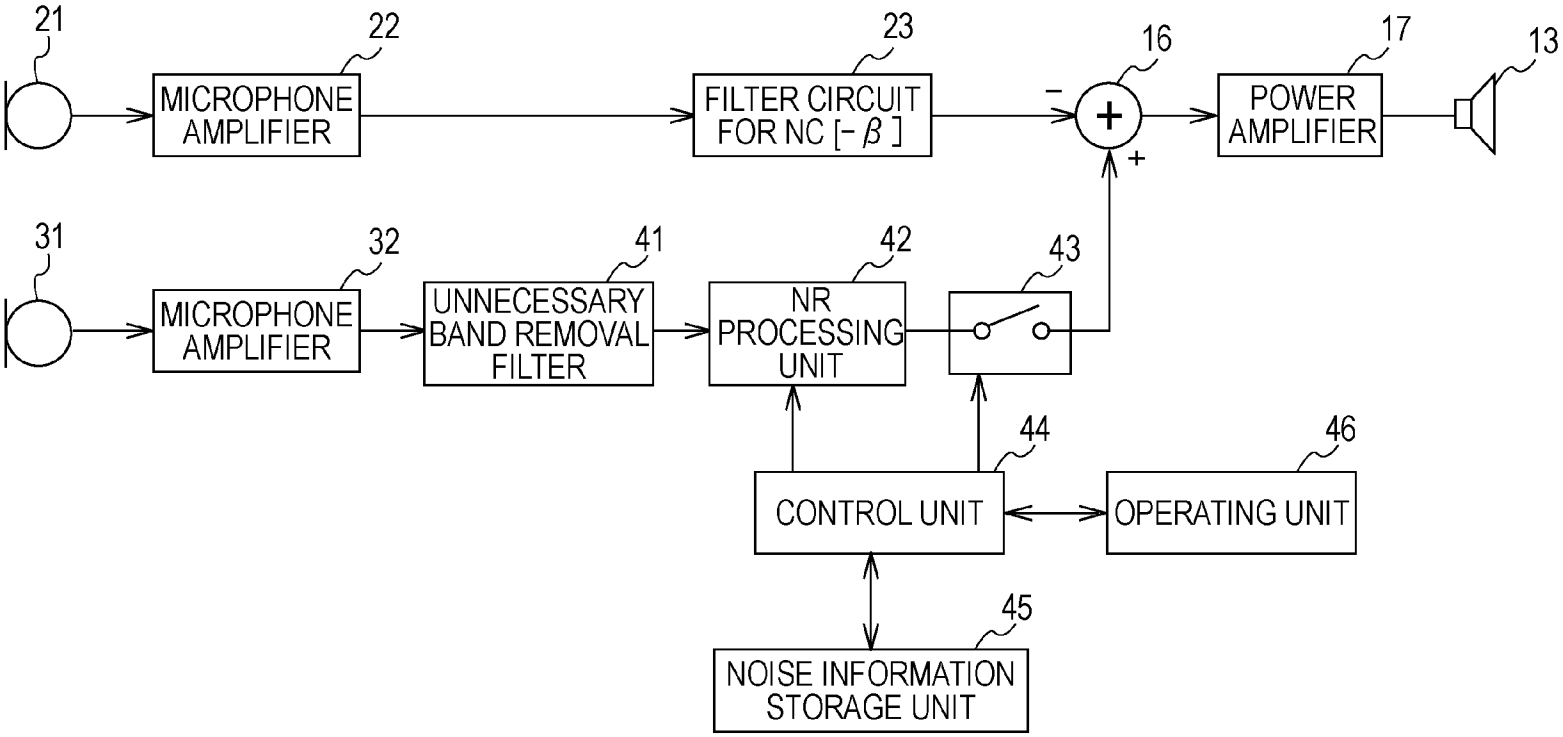
FIG. 21 is a block diagram illustrating a hardware configuration example of a fifth embodiment of the noise reduction audio reproducing device according to the present invention.

The fifth embodiment is the case where the NC processing system employs the feedback method. FIG. 21 is a diagram illustrating a hardware configuration example of a noise reduction audio reproducing device according to the fifth embodiment. The example in FIG. 21 is a configuration corresponding to monaural, but the configuration in FIG. 21 is provided in each of the left and right channels, whereby a configuration corresponding to stereo can also be employed. With the example in FIG. 21 as well, the same portions as those in the above-mentioned embodiments are denoted with the same reference numerals.

Specifically, with the fifth embodiment, the audio signal collected at the microphone 21 provided within the headphone casing is supplied to the filter circuit for NC (FB filter circuit) 23 of the feedback method through the microphone amplifier 22. Subsequently, the audio signal for NC from the filter circuit for NC 23 is supplied to the adding circuit 16.

On the other hand, the audio signal from the microphone 31 attached to the outside of the headphone casing is supplied to the unnecessary band removal filter 41 through the microphone amplifier 32. Subsequently, in the same way as with the above-mentioned first and second embodiments, the output audio signal of the unnecessary band removal filer 41 is supplied to the NR processing unit 42, and is audio-emphasized by being subjected to, for example, the NR processing by the SS method. Subsequently, the audio-emphasized audio signal is supplied to the adding circuit 16 through the switch circuit 43, and is added to the audio signal for NC. Subsequently, the audio signal from the adding circuit 16 is supplied to the headphone driver 13 through the power amplifier 17.

With the fifth embodiment, the same processing operation as that in the above-mentioned first and second embodiments is performed except that the NC processing is performed by the feedback method, and the same operation effects are obtained.

Sixth Embodiment

Figure 22:
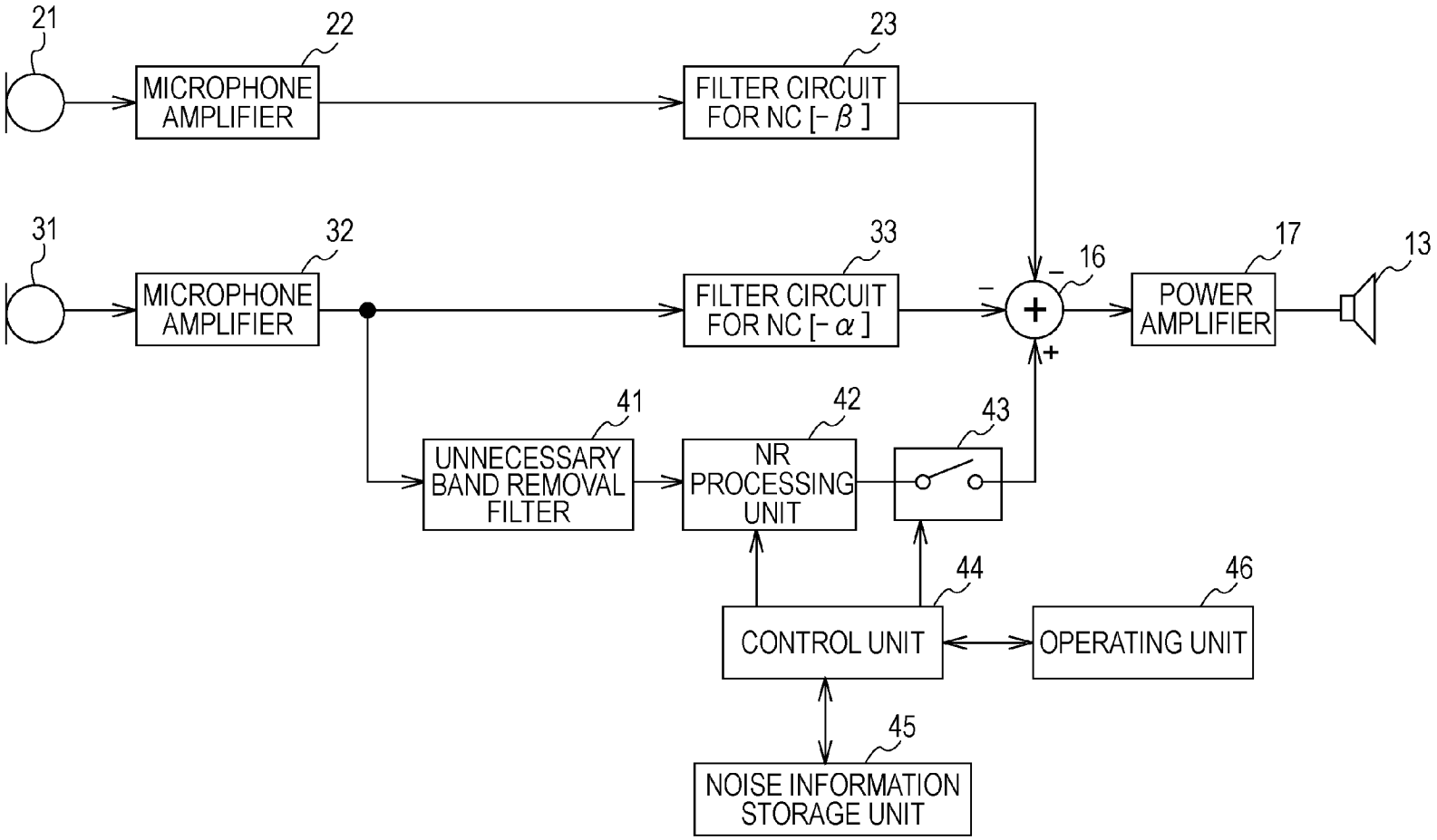
FIG. 22 is a block diagram illustrating a hardware configuration example of a sixth embodiment of the noise reduction audio reproducing device according to the present invention.
Figure 23:
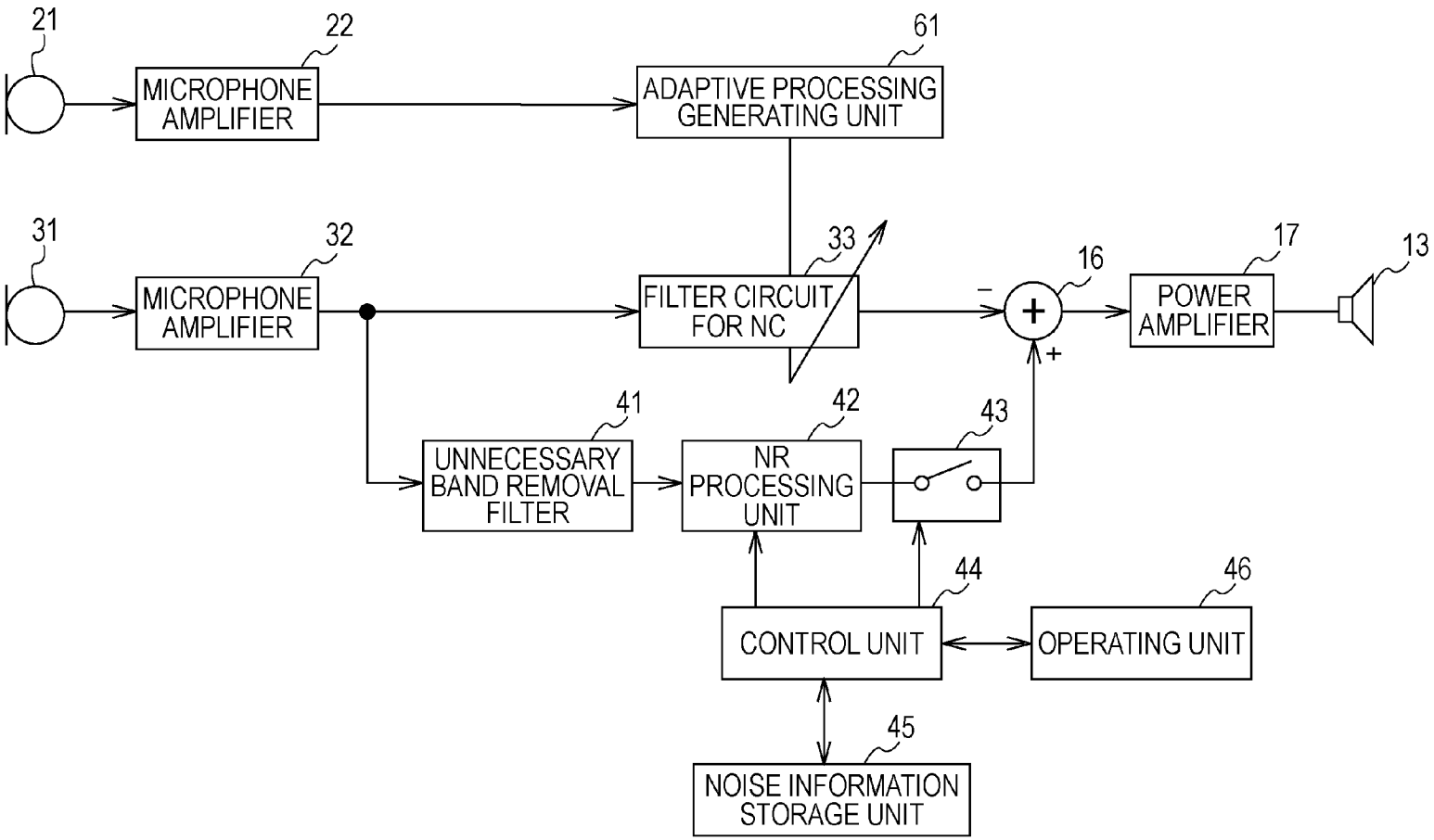
FIG. 23 is a block diagram illustrating a hardware configuration example of a seventh embodiment of the noise reduction audio reproducing device according to the present invention.

The sixth embodiment is the case wherein the NC processing system employs the feedback method and feed-forward method together. FIG. 22 is a diagram illustrating a hardware configuration example of a noise reduction audio reproducing device according to the sixth embodiment. The example in FIG. 22 is a configuration corresponding to monaural, but the configuration in FIG. 22 is provided in each of the left and right channels, whereby a configuration corresponding to stereo can also be employed. With the example in FIG. 22 as well, the same portions as those in the above-mentioned embodiments are denoted with the same reference numerals.

Specifically, with the sixth embodiment, the audio signal collected at the microphone 21 provided within the headphone casing is supplied to the filter circuit for NC (FB filter circuit) 23 of the feedback method through the microphone amplifier 22. Subsequently, the audio signal for NC from the filter circuit for NC 23 is supplied to the adding circuit 16.

Also, the audio signal from the microphone 31 attached to the outside of the headphone casing is supplied to the filter circuit for NC (FF filter circuit) 33 of the feed-forward method through the microphone amplifier 32. Subsequently, the audio signal for NC from the filter circuit for NC 33 is supplied to the adding circuit 16.

Further, the audio signal from the microphone 31 attached to the outside of the headphone casing is supplied to the unnecessary band removal filter 41 through the microphone amplifier 32. Subsequently, in the same way as with the above-mentioned first and second embodiments, the output audio signal of the unnecessary band removal filer 41 is supplied to the NR processing unit 42, and is audio-emphasized by being subjected to, for example, the NR processing by the SS method. Subsequently, the audio-emphasized audio signal is supplied to the adding circuit 16 through the switch circuit 43, and is added to the audio signal for NC. Subsequently, the audio signal from the adding circuit 16 is supplied to the headphone driver 13 through the power amplifier 17.

With the sixth embodiment, the same processing operation as that in the above-mentioned first and second embodiments is performed except that the NC processing is performed by employing the feedback method and feed-forward method together, and the same operation effects are obtained.

Seventh Embodiment

The seventh embodiment is an example wherein the NC processing system is performed by the feedback method, but the filter coefficient of the filter circuit for NC thereof is controlled in an adaptive manner.

Specifically, with the seventh embodiment, the audio signal from the microphone 31 attached to the outside of the headphone casing is supplied to the filter circuit for NC 33 of the feed-forward method through the microphone amplifier 32. Subsequently, the audio signal for NC from the filter circuit for NC 33 is supplied to the adding circuit 16.

Also, the audio signal collected at the microphone 21 provided within the headphone casing is supplied to an adaptive processing generating unit 61 through the microphone amplifier 22. The adaptive processing generating unit 61 generates the filter coefficient of the filter circuit for NC 33 in an adaptive manner to supply this to the filter circuit for NC 33.

Specifically, the audio signal for NC is reproduced acoustically by the headphone driver 13, thereby canceling the noise in the acoustic reproduction space within the headphone casing. The adaptive processing generating unit 61 controls generation of the filter coefficient of the filter circuit for NC 33 in an adaptive manner such that the residual error of noise included in the audio signal after noise canceling obtained from the microphone 21 becomes zero.

Thus, with the seventh embodiment, noise in the actual audio reproduction environment is typically canceled in an adaptive manner.

With the seventh embodiment as well, the audio signal from the microphone 31 attached to the outside of the headphone casing is supplied to the unnecessary band removal filter 41 through the microphone amplifier 32. Subsequently, in the same way as with the above-mentioned first and second embodiments, the output audio signal of the unnecessary band removal filer 41 is supplied to the NR processing unit 42, and is audio-emphasized by being subjected to, for example, the NR processing by the SS method. Subsequently, the audio-emphasized audio signal is supplied to the adding circuit 16 through the switch circuit 43, and is added to the audio signal for NC. Subsequently, the audio signal from the adding circuit 16 is supplied to the headphone driver 13 through the power amplifier 17.

With the seventh embodiment, the same processing operation as that in the above-mentioned first and second embodiments is performed except that the NC processing is performed by employing the feed-forward method, and the filter coefficient thereof is controlled in an adaptive manner, and the same operation effects are obtained.

Other Embodiments

With the above-mentioned embodiments, the audio signal of human voice collected at the microphone at a certain point of time has been audio-emphasized by the NR processing or the like, but at the time of reproduction of the audio signal recorded once the reproduced audio may be emphasized.

Figure 24A:
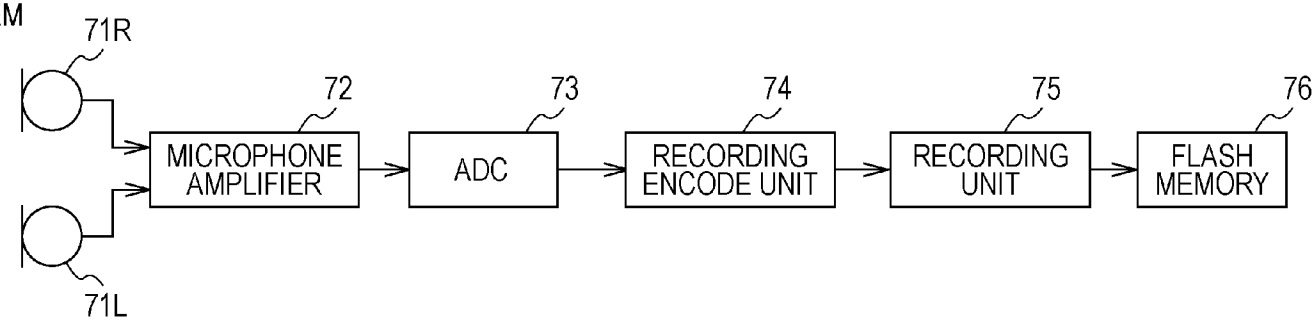
FIGS. 24A and 24B are block diagrams illustrating a hardware configuration example of another embodiment of the noise reduction audio reproducing device according to the present invention.
Figure 24B:
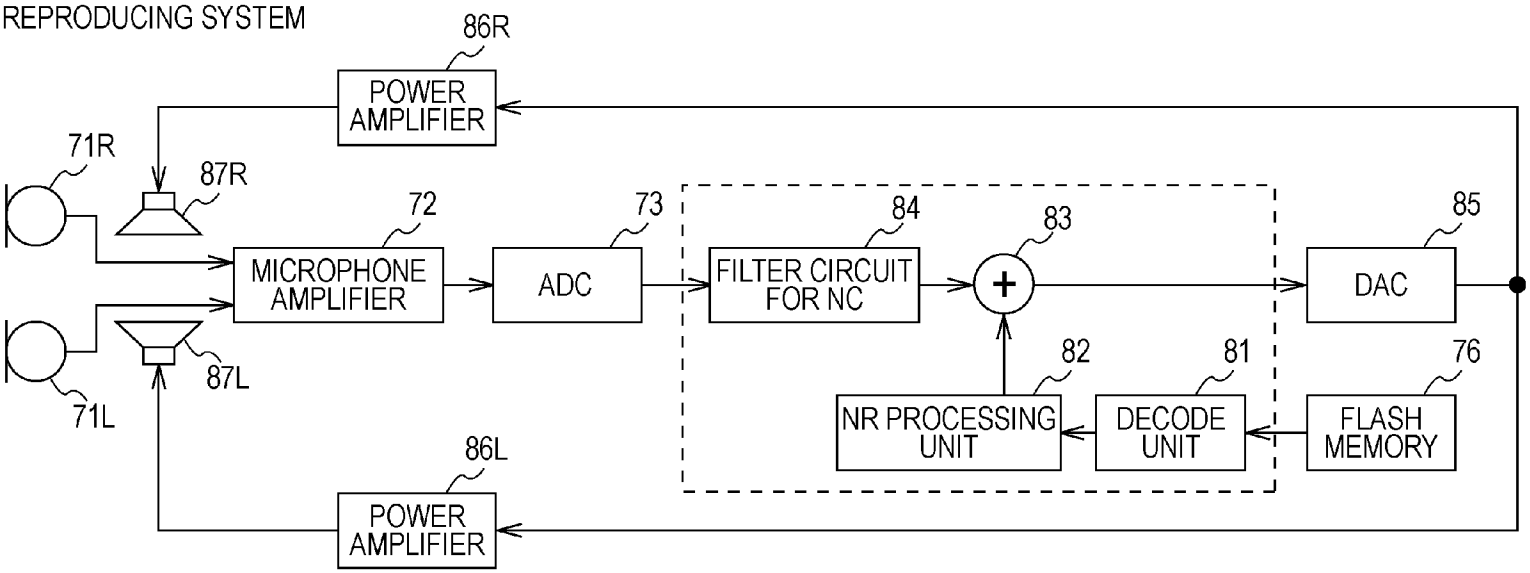
Figure 25A:
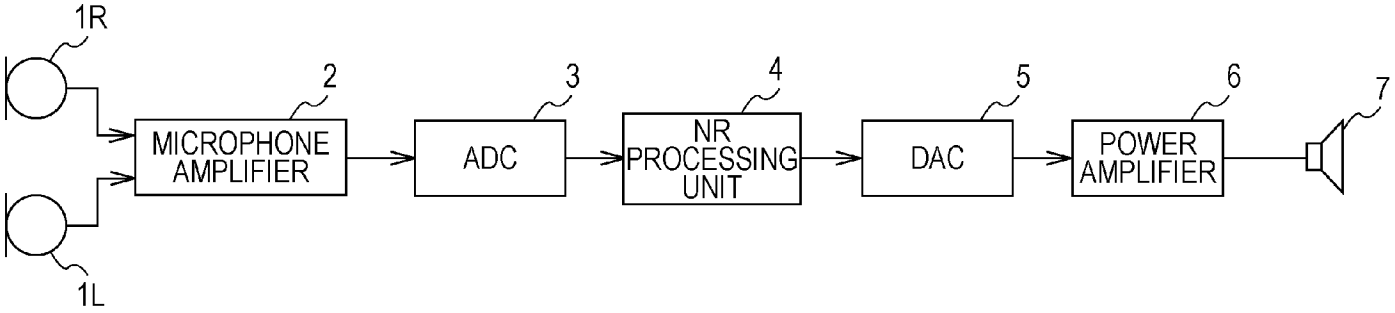
FIGS. 25A and 25B are diagrams for describing NR processing.
Figure 25B:
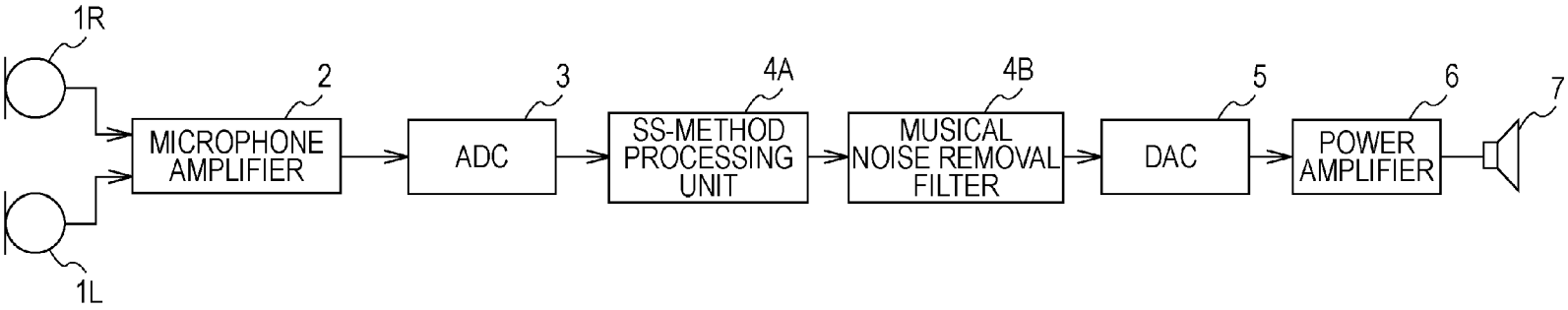

FIGS. 24A and 24B are block diagrams for describing a configuration example in the case of an IC recorder, FIG. 24A illustrates a configuration example of the recording system thereof, and FIG. 24B illustrates a configuration example of the reproducing system thereof.

The IC recorder in this example includes two microphones 71L and 71R, and as shown in FIG. 24A, the audio signals of audios collected at the two microphones 71L and 71R are converted into digital audio signals at an A/D converter 73 through a microphone amplifier 72.

Subsequently, the digital audio signals from the A/D converter 73 are subjected to recording encoding processing including data compression and so forth at a recording encode unit 74, and are then recorded in a recording medium, i.e., flash memory 76 in this example through a recording unit 75. The recording encode unit 74 is configured of a DSP.

The digital audio signals thus recorded in the flash memory 76 are reproduced at a reproducing system such as shown in FIG. 24B. Specifically, the digital audio signals read out from the flash memory 76 are decoded at a decode unit 81, and are then supplied to an NR processing unit 82, where the NR processing according to, for example, the SS method or the like is performed. For example, the power spectrum of noise which was collected at the time of recording, and recorded in, for example the flash memory 76 can be employed as the power spectrum of the noise to be employed for the NR processing according to the SS method.

The reproduced audio signals audio-emphasized by an NR processing unit 82 are supplied to adding circuit 83. On the other hand, the audio signals of audios collected at the microphones 71L and 71R are converted into digital audio signals at the A/D converter 73 through the microphone amplifier 72. Subsequently, the digital audio signals from the A/D converter 73 are supplied to a filter circuit for NC 84.

In this example, a filter circuit for NC according to the feed-forward method is employed as the filter circuit for NC 84. The filter circuit for NC 84 generates audio signals for NC, and supplies the generated audio signals for NC to the adding circuit 83.

The addition signals of the audio signals for NC from the adding circuit 83, and the reproduced audio signals subjected to the NR processing and audio-emphasized are converted into analog audio signals at a D/A converter 85. Subsequently, the analog audio signals from the D/A converter 85 are supplied to speakers or headphone drivers 87L and 87R through power amplifiers 86L and 86R, respectively. Note that, in FIG. 24B, a configuration portion surrounded with a dotted line is a portion configured of a DSP.

With the above-mentioned configuration, the noise in the actual audio reproduction environment is canceled by the audio signals for NC from the filter circuit for NC 84. Subsequently, the reproduced audio is audio-emphasized by the NR processing, and is reproduced acoustically. Accordingly, the reproduced audio becomes articulate listenable audio.

Other Embodiments and Modifications

With the other embodiments excluding the above-mentioned fourth embodiment, the SS method is employed for the NR processing unit. Accordingly, control has been performed such that when the audio monitor button is pressed, first, the noise collection mode for obtaining the power spectrum of noise is activated, and subsequently, the noise reduction mode is activated, but the noise collection mode may be executed at another timing section.

For example, an arrangement may be made wherein the noise collection mode is automatically activated at the time of the power being turned on, or at a certain time interval, and the power spectrum of noise is stored in the noise information storage unit.

Alternatively, an arrangement may be made wherein when input of the microphone becomes large volume of sound, or when external environmental noise is changed, or the like, the noise collection mode is automatically activated, and the power spectrum of noise is stored in the noise information storage unit. Change in external environmental noise can be detected, for example, by monitoring the audio signal level of the microphone 31 to detect that the audio signal level thereof changes exceeding a threshold level.

In such a case, the audio monitor button ON section can be set to the noise reduction mode section alone, as shown in FIG. 19. Subsequently, with the normal NC mode section, the normal NC mode is switched to the noise collection mode as appropriate, where collection and storage of the power spectrum of noise is performed.

Also, the noise reduction mode can also be activated automatically instead of the time when the audio monitor button is pressed. For example, with regard to the audio signal from the microphone 31, determination is made regarding whether or not a human voice audio signal is included in the audio signal thereof, and when determining that a human voice audio signal is included, the normal NC mode can be switched to the noise reduction mode automatically.

Alternatively, an arrangement may be made wherein a determining unit for determining that a quiet audio reproduction environment is changed to a noisy audio reproduction environment are provided, and according to the determination result of the determining unit thereof, when changing to a noisy audio reproduction environment, the noise reduction mode is activated automatically. In this case, it is desirable that the noise collection mode is activated at the first timing section wherein changing to a noisy audio reproduction environment has been detected, and the power spectrum of noise in such an environment is stored in the noise information storage unit.

Note that it goes without saying that the NR processing unit is not restricted to the above-mentioned SS method, and various techniques can be employed.

Also, with the description of the above-mentioned embodiments, an analog audio signal has been employed as the audio signal to be supplied to the headphone driver, and accordingly, the D/A converter and power amplifier have been provided. However, in a case where the headphone driver can be driven by a digital audio signal, it is desirable to provide a digital amplifier instead of the D/A converter and power amplifier.

Also, with the above-mentioned embodiments, the switch circuits 43 and 430 which turn on in the noise reduction mode, and turn off in the other mode have been provided. However, an arrangement may be made wherein the control unit 44 controls on/off of operation of the NR processing units 42 and 420, or audio emphasizing circuit 500, or performs muting control of the output audio signal of the NR processing units 42 and 420, or audio emphasizing circuit 500, thereby omitting the switch circuits.

Also, the above-mentioned embodiments are the case where the noise reduction audio reproducing device has been applied to the headphone device, and description has been made wherein the filter circuit for NC, NR processing unit, audio emphasizing circuit, control unit, and so forth are provided. However, an arrangement may be made wherein, only the microphone and headphone driver are provided in the headphone device, and configuration portions such as the filter circuit for NC, NR processing unit, audio emphasizing circuit, control unit, and so forth are provided in a music reproducing device or the like to which the headphone device is connected.

Also, the present invention may be applied to a headphone device serving as a noise reduction device for reducing external noise instead of the headphone device for music reproduction. Also, the present invention may be configured as a hearing aid.

The present application contains subject matter related to that disclosed in Japanese Priority Patent Application JP 2008-168373 filed in the Japan Patent Office on Jun. 27, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A noise reduction audio reproducing device comprising:

a noise cancel processing unit comprising at least one processor programmed to apply digital feedforward filtering to noise collected by a microphone to provide a filtered noise signal, wherein the noise cancel processing unit is arranged to output a noise cancellation audio signal based on the filtered noise signal;

a noise reduction processing unit configured to provide an emphasized audio signal by emphasizing an audio component in a first audio signal to be listened to;

a synthesizing unit arranged to synthesize an output audio signal based on the noise cancellation audio signal and said emphasized audio signal, and to supply said output audio signal to an electro-acoustic converting unit; and a control unit configured to perform control so as to supply said emphasized audio signal to said synthesizing unit based on a control signal, wherein the control signal, when applied to activate a switch circuit coupled between the noise reduction processing unit and the synthesizing unit, enables the emphasized audio signal to be supplied from said noise reduction processing unit to the synthesizing unit.

2. The noise reduction audio reproducing device according to claim 1, further comprising:

an equalizer circuit arranged to receive a second audio signal and provide a modified second audio signal to the synthesizing unit.

3. A noise reduction audio reproducing device comprising:

a noise cancellation generating unit comprising at least one processor programmed to apply digital feedforward filtering to noise collected by a microphone to provide a filtered noise signal, wherein the noise cancellation generating unit is arranged to generate a noise cancellation audio signal based on the filtered noise signal;

an electro-acoustic converting unit configured to reproduce said noise cancellation audio signal acoustically;

a noise reduction processing unit configured to provide an emphasized audio signal by emphasizing an audio component in an input signal to be listened to;

a synthesizing unit arranged to synthesize an output audio signal based on the noise cancellation audio signal and the emphasized audio signal, and to supply said output audio signal to said electro-acoustic converting unit; and a control unit configured to perform control so as to supply said emphasized audio signal to said synthesizing unit based on a control signal, wherein the control signal, when applied to activate a switch circuit coupled between the noise reduction processing unit and the synthesizing unit, enables the emphasized audio signal to be supplied from said noise reduction processing unit to the synthesizing unit.

4. The noise reduction audio reproducing device according to claim 1, wherein said noise reduction processing unit comprises a plurality of audio emphasizing units, the plurality of audio emphasizing units configured of units for emphasizing said audio component to be listened to by subtracting a power spectrum of the noise stored in a storage unit beforehand from the power spectrum of the input audio signal.

5. The noise reduction audio reproducing device according to claim 4, further comprising:

a power spectrum determining unit configured to obtain the power spectrum component of said noise from said input audio signal, and to store the power spectrum in said storage unit beforehand.

6. The noise reduction audio reproducing device according to claim 4, further comprising:

an operation input unit configured to accept operation input;

wherein said control unit performs control such that, the power spectrum component of said noise is obtained from said input audio signal and is stored in said storage unit in response to receipt of a first operation input by the operation input unit, said audio component to be listened to is emphasized by subtracting the power spectrum of the noise stored in said storage unit from the power spectrum of said input audio signal, and said emphasized audio signal is supplied to said synthesizing unit.

7. The noise reduction audio reproducing device according to claim 1 or claim 3, further comprising:

an operation input unit configured to accept operation input;

wherein said control unit is configured to generate said control signal based on said operation input through said operation input unit.

8. The noise reduction audio reproducing device according to claim 3, wherein said noise reduction processing unit comprises a plurality of audio emphasizing units, the plurality of audio emphasizing units configured of units for emphasizing said audio component to be listened to by subtracting a power spectrum of the noise stored in a storage unit beforehand from the power spectrum of said input audio signal.

9. The noise reduction audio reproducing device according to claim 3, wherein said noise reduction processing unit comprises a plurality of audio emphasizing units, the plurality of audio emphasizing units configured of units for emphasizing said audio component to be listened to by subtracting a power spectrum of the noise stored in a storage unit beforehand from the power spectrum of the noise cancellation audio signal from said noise cancellation generating unit.

10. The noise reduction audio reproducing device according to claim 9, further comprising:

a power spectrum determining unit configured to obtain the power spectrum component of said noise from said noise cancellation audio signal, and to store the power spectrum in said storage unit beforehand.

11. The noise reduction audio reproducing device according to claim 9, further comprising:

an operation input unit configured to accept operation input;

wherein said control unit performs control such that, the power spectrum component of said noise is obtained from said noise cancellation audio signal and is stored in said storage unit in response to receipt of a first operation input by the operation input unit, said audio component to be listened to is emphasized by subtracting the power spectrum of the noise stored in said storage unit from the power spectrum of said noise cancellation audio signal, and said emphasized audio signal is supplied to said synthesizing unit.

12. A noise reduction audio reproducing method comprising steps of:

generating a noise cancellation audio signal based on noise collected using a microphone, wherein generating the noise cancellation audio signal comprises applying digital feed-forward filtering to the noise collected using the microphone;

emphasizing an audio component of an input audio signal to be listened to provide an emphasized audio signal;

synthesizing, with a synthesizing unit, an output audio signal based on the noise cancellation audio signal and the emphasized audio signal;

supplying the output audio signal to an electro-acoustic converting unit; and controlling when the emphasized audio signal is supplied to the synthesizing unit based on a control signal, wherein the control signal, when applied to activate a switch circuit coupled between the noise reduction processing unit and the synthesizing unit, enables the emphasized audio signal to be supplied to the synthesizing unit.

13. A noise reduction audio reproducing method comprising:

generating, from a collected and obtained audio signal of noise, a noise cancellation audio signal to cancel said noise in an input signal, wherein generating the noise cancellation audio signal comprises applying digital feed-forward filtering to the noise collected using the microphone;

reproducing said noise cancellation audio signal for noise cancellation acoustically;

emphasizing an audio component of the input signal to be listened to produce an emphasized audio signal;

synthesizing, with a synthesizing unit, an output audio signal based on said noise cancellation audio signal and said emphasized audio signal;

supplying said output audio signal to an electro-acoustic converting unit; and controlling when the emphasized audio signal is supplied to the synthesizing unit based on a control signal, wherein the control signal, when applied to activate a switch circuit coupled between the noise reduction processing unit and the synthesizing unit, enables the emphasized audio signal to be supplied to the synthesizing unit.

* * * * *